US005950055A

United States Patent [19]

Yahata et al.

[11] Patent Number: 5,950,055

[45] Date of Patent: Sep. 7, 1999

[54] POWDER PUMP AND IMAGE FORMING APPARATUS HAVING THE POWDER PUMP AND METHOD THEREFOR

[75] Inventors: Masazumi Yahata, Kamakura; Shunji Katoh, Sagamihara; Yuuji Kitajima, Kawasaki; Masakuni Konja, Yokohama; Satoshi Takano, Tokyo; Fumihito Itoh, Yokohama, all of Japan

[73] Assignee: Ricoh Company, Ltd., Tokyo, Japan

[21] Appl. No.: 09/062,445

[22] Filed: Apr. 17, 1998

[30] Foreign Application Priority Data

| | | | |
|---|---|---|---|
| Apr. 18, 1997 | [JP] | Japan | 9-116424 |
| Feb. 18, 1998 | [JP] | Japan | 10-052820 |
| Feb. 18, 1998 | [JP] | Japan | 10-052821 |
| Feb. 23, 1998 | [JP] | Japan | 10-057512 |

[51] Int. Cl.[6] ..... G03G 15/08

[52] U.S. Cl. ..... 399/252; 399/359; 399/258

[58] Field of Search ..... 399/252, 360, 399/258, 359, 260, 358; 222/DIG. 1

[56] References Cited

U.S. PATENT DOCUMENTS

| | | | |
|---|---|---|---|
| 4,384,785 | 5/1983 | Katoh et al. . | |
| 5,493,382 | 2/1996 | Takagaki et al. . | |
| 5,561,506 | 10/1996 | Kasahara | 222/DIG. 1 |
| 5,604,576 | 2/1997 | Inoue et al. . | |
| 5,797,074 | 8/1998 | Kasahara et al. | 399/262 |
| 5,815,784 | 9/1998 | Kasahara et al. | 399/359 |

FOREIGN PATENT DOCUMENTS

| | | |
|---|---|---|
| 6-43911 | 6/1994 | Japan . |
| 6-278228 | 10/1994 | Japan . |
| 9-288397 | 11/1997 | Japan . |
| 9-292773 | 11/1997 | Japan . |

*Primary Examiner*—Richard Moses
*Attorney, Agent, or Firm*—Cooper & Dunham LLP

[57] ABSTRACT

A powder pump includes a case, a diaphragm, a working chamber which is partitioned with the case and the diaphragm, a powder inlet formed on the case for flowing the powder into the working chamber, a powder outlet formed on the case for flowing the powder in the working chamber out of the powder outlet, an inlet valve which opens the powder inlet when pressure in the working chamber is decreased by an operation of the diaphragm so that the powder flows into the working chamber from the powder inlet and shuts the powder inlet when the pressure in the working chamber is raised by the operation of the diaphragm, and an outlet valve which opens an outlet when the pressure in the working chamber is raised by the operation of the diaphragm, so as to let the powder flow through the powder outlet outside of the working chamber and shuts the powder outlet when the pressure in the working chamber is lowered by the operation of the diaphragm. The powder pump further includes a first space which is formed so as to communicate with the working chamber located at a place around a case wall part which partitions the powder inlet, and a second space which is formed so as to communicate with a powder flowing path located at the downstream side of a powder conveying direction from the outlet valve. The powder pump is utilized for conveying the toner in an image forming apparatus.

24 Claims, 17 Drawing Sheets

POWDER PUMP AND IMAGE FORMING APPARATUS HAVING THE POWDER PUMP AND METHOD THEREFOR

BACKGROUND OF THE INVENTION

1. Field of the Invention

The present invention relates to an image forming apparatus and a powder pump utilized therein, and more particularly to an image forming apparatus that uses electrophotography to form an image with a toner which is conveyed by a screw pump and fed by gas (mixed gas) across a distant path from a developing station towards a latent image formed on an image bearing member thereof.

2. Discussion of the Background

In image forming apparatuses such as printers, facsimile machines, copying machines, and multi functional machines, toner is transferred onto a photoconductive element for forming a toner image. The toner image is transferred onto a transfer sheet and used residual toner that has not transferred onto the transfer sheet is collected by a cleaning device. The used residual toner is recycled to be reused for developing during a subsequent image forming operation by returning the residual toner to the developing device.

It is well known that the toner in the developer is supplied to the developing device by a pump, circulating with flowing gas.

As shown in FIGS. 12 and 13, a system is shown for reusing a residual toner which has not adhered onto an image bearing member 101 employed as a drum-shaped photoconductor, or onto a belt-shaped transfer member (not shown). The residual toner is scraped off of image bearing member 101 by a cleaning blade 107*a* and collected in cleaning unit 107. The collected toner is exhausted from an exhaust pipe 107*b* of the cleaning unit 107 and is dropped into a lateral conveying screw case 108*a* via a connecting device 108. A rotational drive power of a drive motor 109 is transmitted to lateral conveying screw 108*b* in the lateral conveying screw case 108*a*, via a belt 109*b* and a pulley 109*c* forming a rotational drive power transmitting device 109*a*. The collected residual toner is conveyed into a stator 103*a* by rotation of the lateral conveying screw 108*b*. Lateral conveying screw 108*b* rotates together with a rotor 103*b* in the stator 103*a*, stator 103*a* being held in position by a holder 103*c* of a screw pump 103.

The toner is conveyed by rotation of the rotor 103*b* in the stator 103*a* of the screw pump 103 into a mixed gas conveying device 105 that is connected to an exit 103*d* of the stator 10*a*. A pump 104 blows air into holder 103*c* at the same time. The air is collected from a developing device 102 and is circulated via conveying pipe 104*a*, into the screw pump 103 through the air conveying tube 104*a*, and the air mixes with toner in the mixed gas conveying device 105. Toner scattering which can occur when decompression occurs at a hopper 102*a* of the developing device 102 is prevented since an air suction pipe of the powder pump 104 is connected to the hopper 102*a* of the developing device 102 and the gas is conveyed from the mixed gas conveying device 105 to the hopper 102*a* of the developing device 102. Further, there has been proposed by the inventor of the present invention an image forming apparatus in which toner is supplied from a position distant from the developing station, to the developing device 102 and having an air circulation path with little air loss.

However, such a conventional image forming apparatus has the following shortcoming. Each element of the apparatus is positioned to form a circulation path for circulating the air for fluidifying the toner passed by the mixed gas conveying device 105. The elements are arranged in the order of the hopper 102*a* for supplying a toner to the developing device 102, the powder pump 104, the screw pump 103, and the hopper 102*a* for supplying the toner to the developing device 102. However, over time, a gap tends to form between the stator 103*a* and the rotor 103*b* of the screw pump 103 which are respectively composed of rubber materials. The gap is formed because of normal wear of the stator 103*a* and rotor 103*b* over time caused by contact and engagement between the stator 103*a* and the rotor 103*b*. Therefore, air inside of the screw pump 103 gradually leaks out to the open air, and consequently the toner conveying ability from an exit 103*d* of the screw pump 103 gradually decreases Eventually, the toner cannot be supplied to the hopper 102*a* for supply to the developing device 102 and an image quality deteriorates. (Refer to FIG. 13)

Furthermore, in such a conventional image forming apparatus, if the powder pump 104 is located at a position lower than the developing device 102 in a vertical direction for reasons such as, for example, saving space, simplifying the drive power source mechanism by using the same drive source for both the powder pump 104 and the other units, or the like, the following shortcomings may occur. The powder pump 104 may malfunction, i.e., the outlet valve (not shown) of powder pump 104 may lock in a closed position due to a build up of toner, or the outlet valve may not be able to fully close shut, or the like. This can occur because toner can get stopped up at the outlet valve side of the powder pump 104 because of a flowing-back of the toner from conveying device 105 or screw pump 103 and/or tube 104*a* due to vibration and gravity effects, for example, since toner will typically remain on an internal wall of mixed gas conveying device 105, pump 103 and/or tube 104*a* after the powder pump 104 has stopped.

A powder pump is often used to feed toner powder, or two-component type developers composed of a toner and carrier, which are used in an image forming apparatus such as a copying machine, a printer, a facsimile device or the like. Such a powder pump, typically includes a stator having two spiral grooves formed at an internal peripheral surface thereof that is composed of an elastic material, and a rotor disposed in the stator. This powder pump is called a one-shaft eccentric screw pump. The screw pump exhales powder (fed from an inlet) from an outlet thereof by rotational drive of the rotor. In such a powder pump, air is fed with compression from a secondary powder pump in order to increase a fluidity of the powder that is exhaled from the powder pump. Thus, in the case of using the powder pump of this type, there is required a secondary powder pump for feeding air to the powder pump resulting in a large-sized structure, and increased manufacturing costs.

Further, if the powder pump is used for extended periods of time, the material of the stator deteriorates and the stator is permanently deformed since the stator is composed of an elastic material such as rubber or the like. Accordingly, air-tightness of a space between the stator and the rotor cannot be maintained, and conveying ability of the powder deteriorates, and ultimately, powder conveyance becomes impossible.

On the other hand, a pump is also well known which draws a fluid into a chamber that is partitioned with a case and a diaphragm from an inlet that is formed on the case, and then ejects the fluid in the chamber from an outlet. The inlet and the outlet of the pump open and shut by operation of an inlet valve and an outlet valve respectively, that are operated by up and down movement of the diaphragm and corresponding pressure changes in the chamber. The pump of this type has a relatively small structure and is manufactured at low cost in comparison with the aforementioned powder pump, having an advantage in this point.

FIG. 11 is a cross sectional view showing such a conventional pump in which a diaphragm is used to convey fluids. Fluid can be conveyed by opening/shutting the inlet 110 and the outlet 106 with movement of the inlet valve 130 and the outlet valve 140 by operation of the diaphragm 5. However, if the pump 100 is used for conveying a powder, the powder tends to accumulate around the powder inlet 110 and the powder outlet 106, or on the inlet valve 130 and the outlet valve 140. Thereby, when the inlet valve 130 and the outlet valve 140 are shut, the valves cannot make close contact at the surfaces of the case wall around the inlet 110 and the outlet 106. That is, air-tightness of the inlet valve 130 and the outlet valve 140 is lost. In this state, a problem occurs that, when the pressure in the working chamber 8 is increased, the powder in the working chamber 108 is discharged through the inlet 110, and when the pressure in the working chamber 108 is decreased, the powder flows into the working chamber 108 through the outlet 106. Therefore, the conveying ability of the pump when used to convey powder is deteriorated. Thus, even though the conventional pump shown in FIG. 11 has an advantage that the size of the pump is more compact than the one-shaft eccentric screw type pump and the manufacturing cost is relatively low, the conventional pump cannot be used for conveying powder.

In other words, even though this conventional pump having the diaphragm can often be used for conveying gas and liquid without problem, it is not without its drawbacks. Due to the configuration of the pump housing sections 102 and 103, if the pump is used to pump powder, the powder would tend to accumulate around the inlet and the outlet that are to be shut by the inlet valve 130 and the outlet valve 140, respectively, or around the inlet valve 130 and the outlet valve 140 themselves. Accordingly, the inlet and the outlet would not be able to be shut securely with the inlet valve 130 and the outlet valve 140, resulting in deterioration of efficient conveyance of the powder. Thus, although the pump of this type is advantageously used for conveying gas and liquid, this pump cannot conventionally be used for conveying powder.

In light of the above considerations, it is highly desirable to provide a pump having a diaphragm (hereinafter called powder pump) which can be used for conveying powder and having structure of compact size and of low manufacturing costs which is stable for use over long periods of time. Further, it is also highly desirable to provide an image forming apparatus utilizing the powder pump for conveying toner in which toner which remains on an internal wall of an elastic tube or the like is prevented from flowing-back to a powder pump side even when vibration occurs to the apparatus after the powder pump is stopped, and thereby the powder pump can be operated under normal conditions resulting in high image quality performance.

SUMMARY OF THE INVENTION

The present invention has been made in consideration of above problems, and accordingly it is an object of the present invention to provide a powder pump and an image forming apparatus utilizing the powder pump for conveying a toner.

The powder pump includes a case, a diaphragm, a working chamber which is partitioned with the case and the diaphragm, a powder inlet formed on a case for flowing powder into the working chamber, a powder outlet formed on the case for flowing the powder in the working chamber out of the powder outlet, an inlet valve which opens the powder inlet when pressure in the working chamber is decreased by an operation of the diaphragm, so that the powder flows into the working chamber from the powder inlet and shuts the powder inlet when the pressure in the working chamber is increased by the operation of the diaphragm, and an outlet valve which opens the powder outlet when the pressure in the working chamber is increased by the operation of the diaphragm, so that the powder flows out from the powder outlet to outside the working chamber and shuts the powder outlet when the pressure in the working chamber is decreased by the operation of the diaphragm.

The powder pump further includes a first space which is formed communicating with the working chamber located around a case wall part which partitions the powder inlet, and a second space which is formed communicating with a powder flowing path located downstream of a powder conveying direction from the outlet valve.

An image forming apparatus in which an image is formed with a toner conveyed with a screw pump to an electrostatic latent image formed on an image bearing member of an electrophotography together with gas as mixed gas supplied from a position apart from a developing position is provided. The image forming apparatus includes an image bearing member which bears a formed image, a developing device which forms a toner image by developing the electrostatic latent image formed on the image bearing member, a screw pump which conveys the toner supply to the image bearing member, a powder pump which circulatingly supplies gas for fluidifying the toner conveyed by the screw pump, a mixed gas conveying device which conveys the mixed gas with toner and gas connected to an inlet and an outlet of the powder pump in which the mixed gas with the toner and the gas passes, and conveys the gas communicating with the developing device, the screw pump, the powder pump, and the developing device, so that a circulating path which circulates the gas in order of the developing device, the screw pump, the powder pump, and the developing device is formed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiments of the present invention are explained hereinafter referring to the accompanying drawings.

Figure 1:
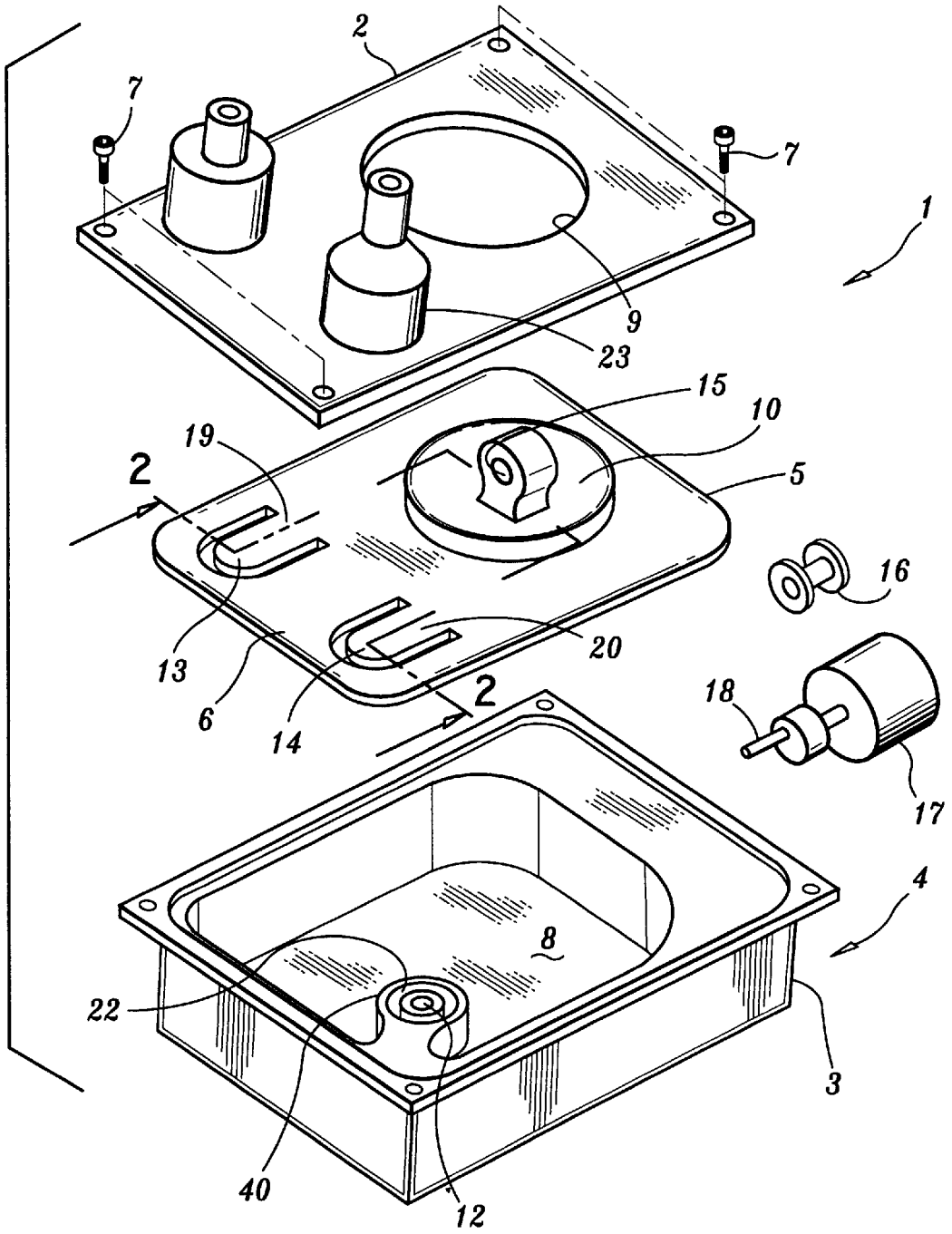
FIG. 1 is an exploded perspective view of a powder pump of the first embodiment of the present invention.
Figure 2:
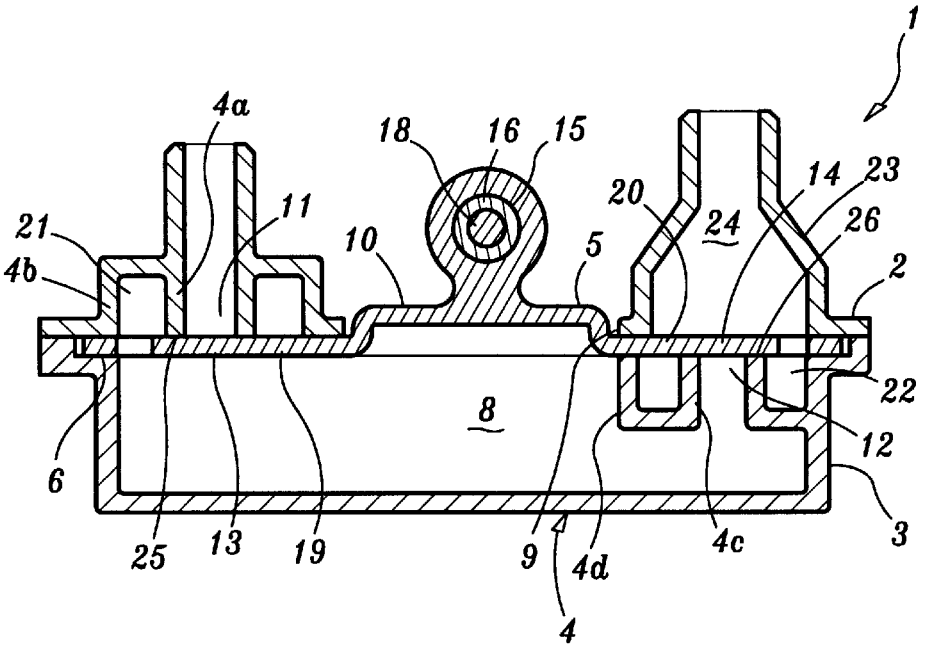
FIG. 2 is a cross sectional view taken along the line II—II in FIG. 1 where each element shown in FIG. 1 is combined.

FIG. 1 is an exploded perspective view of a powder pump according to a first embodiment of the present invention, and FIG. 2 is a cross sectional view taken along the line II—II in FIG. 1 where each element shown in FIG. 1 is combined.

The powder pump 1 shown in FIGS. 1 and 2 has a case 4 composed of a first case member 2 located at an upper side and a second case member 3 located at a lower side. A sheet-like base member 6 of a diaphragm 5 composed of an elastic member such as, for example, rubber, is nipped between the first case member 2 and the second case member 3 and is adhered on the second case member 3. Further, the first case member 2 and the second case member 3 are joined with screws 7. In this state, as shown in FIG. 2, case 4 includes a working chamber 8 partitioned within the second case member 3 by diaphragm 5. A movable part 10 of the diaphragm 5 is located at the position as shown. This movable part 10 is exposed outside of the powder pump 1 and works as described later.

A powder inlet 11 through which powder (not shown) flows into the working chamber 8 is formed in the first case member 2 of the case 4. A powder outlet 12 is formed in the second case member 3 of the case 4, through which powder in the working chamber 8 flows outside of the working chamber 8.

Further, an inlet valve 13 and an outlet valve 14 are mounted in the powder pump 1. In the example shown in FIGS. 1 and 2, these valves 13 and 14 are composed of flexible material formed in a body with the diaphragm 5. The inlet valve 13 is located facing powder inlet 11, and opens and shuts powder inlet 11 as described later by swinging around a base end portion 19 as a center. In the same manner, the outlet valve 14 is located facing powder outlet 12, and opens and shuts the powder outlet 12 by swinging around a base end portion 20 as a center.

Figure 3:
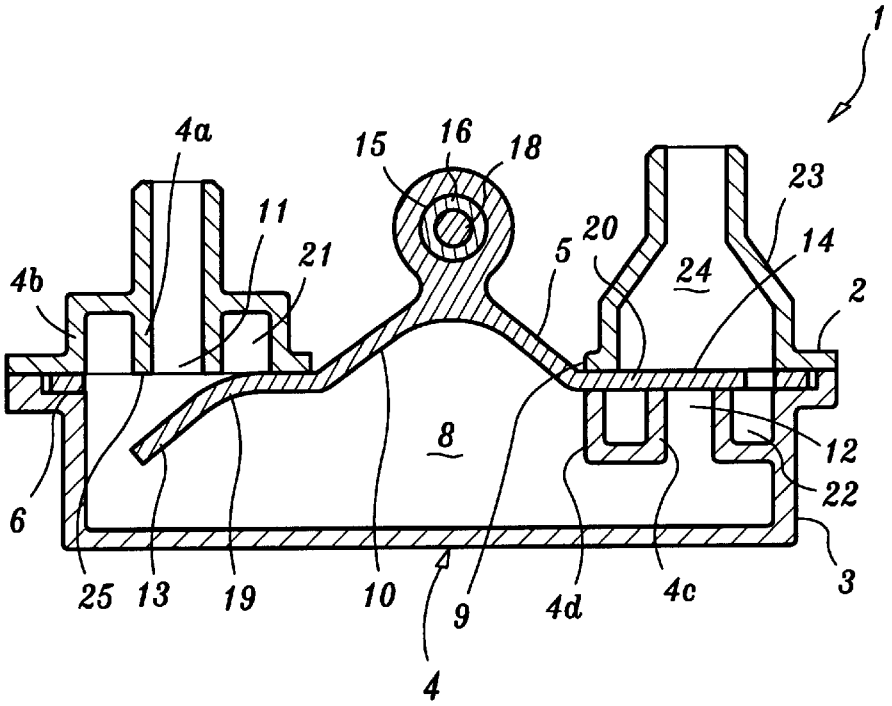
FIG. 3 is a cross sectional view showing an open state of the inlet valve shown in FIG. 2.
Figure 4:
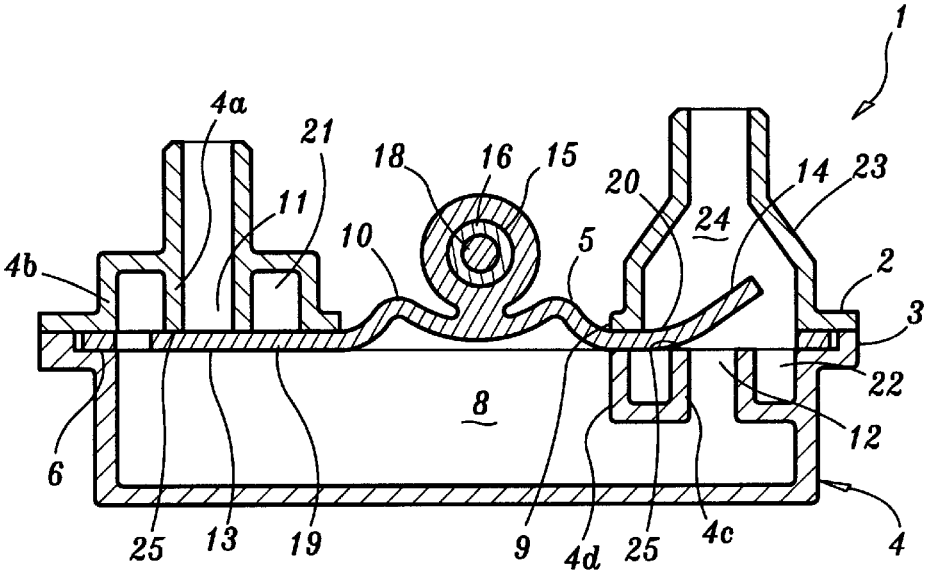
FIG. 4 is a cross sectional view showing an open state of the outlet valve shown in FIG. 2.

A round penetrating hole 15 is formed in movable part 10 of the diaphragm 5, and a cylindrical bearing 16 is loosely fit into the penetrating hole 15. A tip portion of a crank shaft 18 that is rotatably driven by a motor 17 is inserted in bearing 16. When the motor 17 rotates and the crank shaft 18 is rotated, the movable part 10 of the diaphragm 5 is repeatedly elastically deformed in the upward and downward directions as shown in FIGS. 3 and 4. The motor 17 and the crank 18 are an example of the driving device that operates diaphragm 5.

When the movable part 10 of the diaphragm 5 is lifted upwards by an operation of the motor 17 as shown in FIG. 3, the volume of the working chamber 8 is increased and pressure in the working chamber 8 is decreased. Thereby, the inlet valve 13 is operated and the powder inlet 11 is opened. At this time, the outlet valve 14 shuts the powder outlet 12 because of the negative pressure in the working chamber 8. Thus, the powder from outside of the powder pump 1 flows into the working chamber 8 through the powder inlet 11. The fluidity of the powder is increased, since air is supplied and mixed into the powder.

When the movable part 10 of the diaphragm 5 is pushed downwards as shown in FIG. 4 by the continuous operation of the motor 17, the volume of the working chamber 8 is decreased and the pressure of the working chamber 8 is increased. Thereby, the inlet valve 13 shuts the powder inlet 11, and on the other hand the outlet valve 14 releases and opens the powder outlet 12. Then, the powder in the working chamber 8, whose pressure is increased, is discharged from the powder outlet 12 to outside of the powder pump 1. The powder discharged from the powder outlet 12 is conveyed with pressure out of the case through a powder flowing path 24 in a cylindrical part 23 that is formed on the first case member 2.

As the above-described operation is repeated, the powder flows into the working chamber 8 from the powder inlet 11, then the powder flows out from the working chamber 8 through the powder outlet 12. The powder can thus be conveyed from a predetermined position to another position through a leading tube (not shown) connected to the powder inlet 11 and a powder flowing path 24.

As described above, when the pressure in the working chamber 8 is decreased by upward movement of movable part 10 of the diaphragm 5, the inlet valve 13 releases the powder inlet 11 so that the powder flows into the working chamber 8 from the powder inlet 11. When the pressure in the working chamber 8 is increased by downward movement of movable part 10 of the diaphragm 5, the inlet valve 13 shuts the powder inlet 11.

At the same time, because of increased pressure in the working chamber 8, the outlet valve 14 releases and opens the powder outlet 12 so that the powder in the working chamber 8 flows out from the powder outlet 12, and when the pressure in the working chamber 8 is again decreased by the operation of the diaphragm 5, the outlet valve 14 shuts the powder outlet 12.

Figure 11:
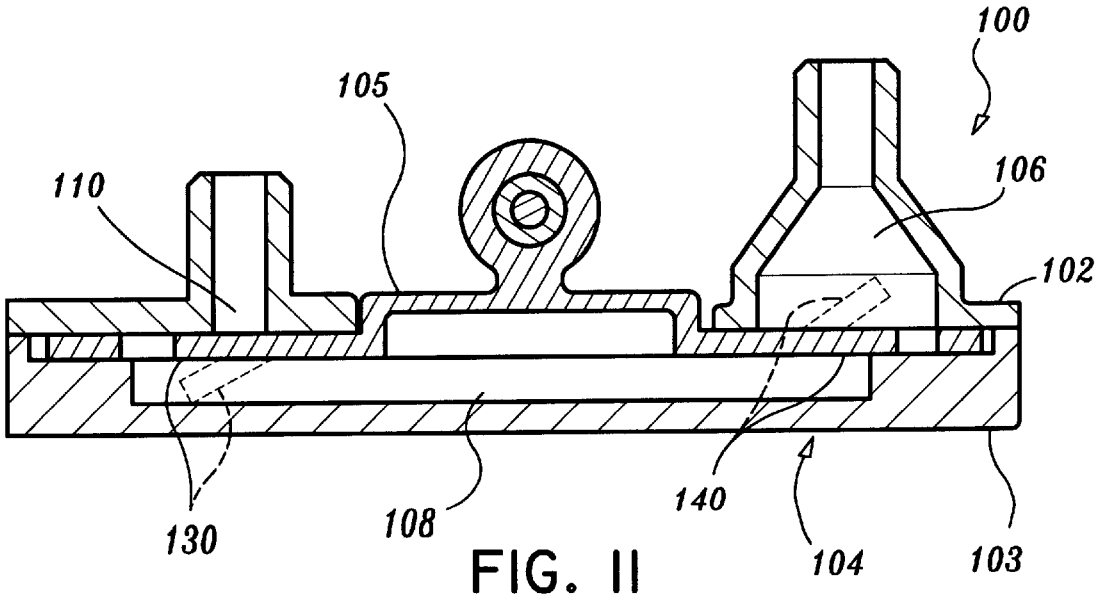
FIG. 11 PRIOR ART
FIG. 11 is a cross sectional view showing a conventional pump.
Figure 12:
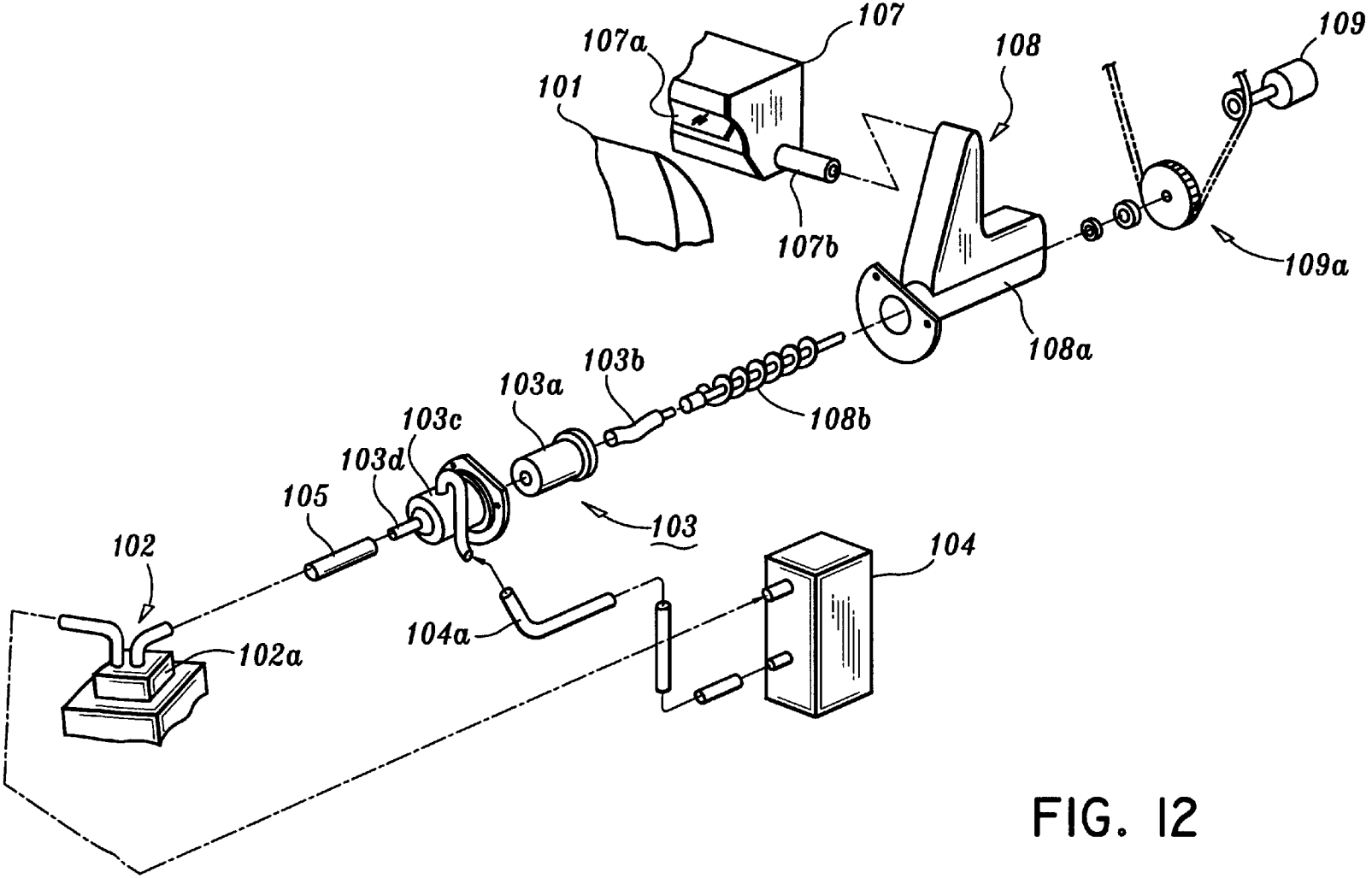
FIG. 12 is an illustration showing a main part of an image forming apparatus of a related art.
Figure 13:
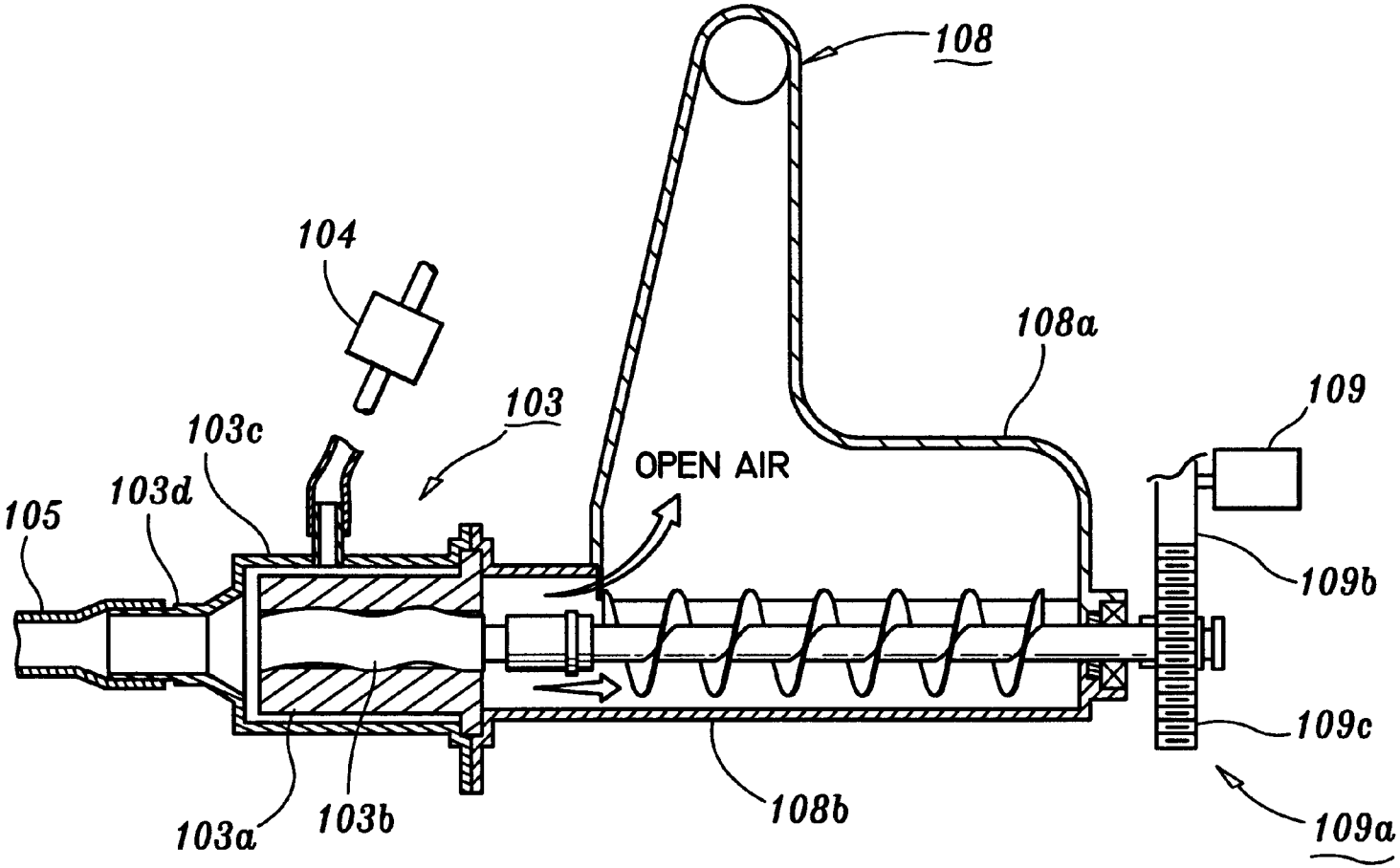
FIG. 13 is a sectional view illustrating another main part of the image forming apparatus of the related art.

The powder pump shown in FIGS. 1–4 has several advantages over the pump shown in FIG. 11 described above. For example, the powder pump shown in FIGS. 1 through 4 includes around a case wall 4A that partitions and defines the powder inlet 11, a first space 21 that is partitioned and defined with a case wall 4B located around the case wall part 4A. As shown most clearly in FIG. 3, the first space 21 communicates with the working chamber 8. In the same manner, there is also formed a second space 22 that is partitioned and defined with a case wall 4D located around a case wall part 4C. As shown most clearly in FIG. 4, the second space 22 communicates with the powder flowing path 24 which is located downstream of the powder conveying direction from the outlet valve 14.

The inlet valve 13 and the outlet valve 14 contact each of ends 25 and 26 of corresponding case walls 4A and 4C that partitions the powder inlet 11 and the powder outlet 12 when the valves 13 and 14 shut. According to this embodiment of the present invention, since the spaces 21 and 22 are formed around the case wall parts 4A and 4C as described above, the area of each of the valves 13 and 14 contacting the respective end surfaces 25 and 26 decreases and contacting pressure per area therefor increases. Therefore, even though powder may accumulate on these end surfaces 25 and 26, or around the valves 13 and 14, the inlet valve 13 and the outlet valve 14 closely contact the end surfaces 25 and 26, respectively, and an air-tightness thereof is increased. Further, the powder can be brushed off from the end surfaces 25 and 26 along with the open and shut movement of each of the valves 13 and 14, since the contact area is small. The powder which has been brushed off from the end surfaces 25 and 26 is immediately displaced into the first and second space 21 and 22 formed around the end surfaces 25 and 26.

The powder which has entered into the first space 21 falls down into the working chamber 8 by shock or vibrations caused by the open and shut movements of the inlet valve 13. In the same manner, the powder which has entered into the second space 22 moves towards the powder flowing path 24 side because of the shock or vibrations caused by the open and shut movement operation of the outlet valve 14, and is then discharged.

Furthermore, in the powder pump 1 shown in FIGS. 1 through 4, the case wall part 4A that partitions the powder inlet 11 is cylindrically formed and the first space 21 is disposed around the entire periphery thereof. In the same manner, the case wall part 4C that partitions powder outlet 12 is cylindrically formed and the second space 22 is disposed around the entire periphery thereof. Accordingly, the area in which the inlet valve 13 and the outlet valve 14 contact the corresponding end surfaces 25 and 26 of each of the case wall part 4A and 4C becomes extremely small. Furthermore, powder which has adhered on the end surfaces 25 and 26, or on the valves 13 and 14 is immediately and efficiently displaced into the first or second space 21 and 22, and therefore the amount of accumulated powder can be particularly decreased. Thus, the air-tightness of the inlet valve 13 and outlet valve 14 with corresponding end surfaces 25 and 26 can effectively be increased.

Accordingly, malfunction caused by the flowing-back of the powder into the working chamber 8 through the powder inlet 11, or the flowing-back of the powder that has already entered into the powder flowing path 24 back into the working chamber 8 through the powder outlet 12 can be prevented. Accordingly, a powder pump 1 having the diaphragm 5 can be used as a pump for conveying powder without trouble.

Figure 5:
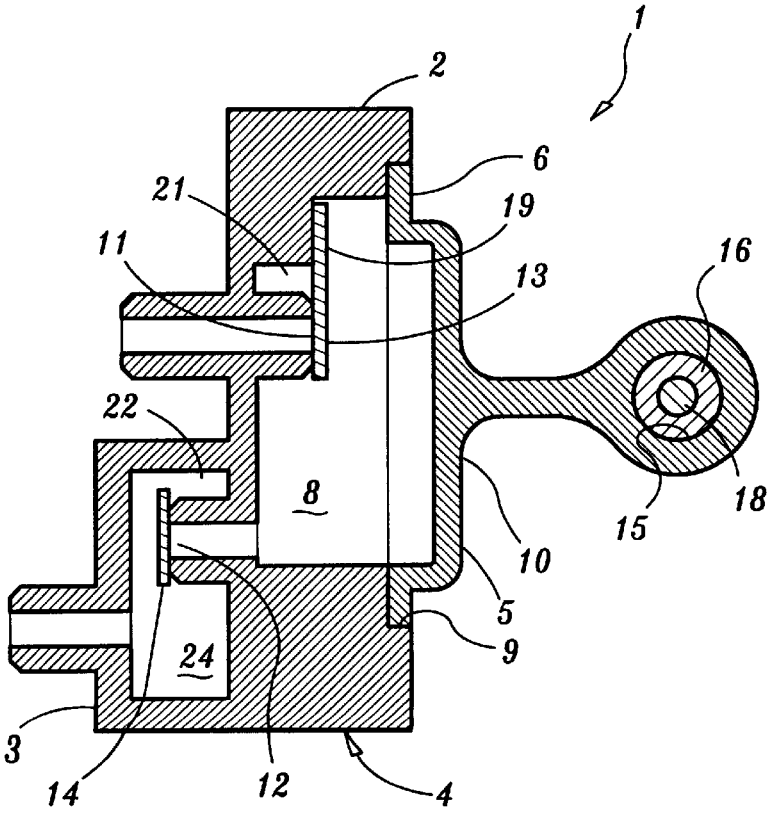
FIG. 5 is a cross sectional view illustrating powder pump according to another embodiment of the present invention.

FIG. 5 is a cross sectional view illustrating another example of the powder pump 1 and a basic construction of this powder pump 1 is the same as the powder pump shown in FIGS. 1 through 4. Therefore, the same element numbers as those in FIGS. 1 through 4 represent the same elements in FIG. 5.

In the powder pump in FIG. 5, powder including air also flows into the working chamber 8 from the powder inlet 11 by releasing the inlet valve 13. The powder in the working chamber 8 is discharged outside of the working chamber 8 through the powder outlet 12 by releasing the outlet valve 14. However, in the example shown in FIG. 5, the powder inlet 11 is disposed higher than the powder outlet 12 so that the powder that flows into the working chamber 8 from the powder inlet 11 can fall down towards the powder outlet 12 side from the powder inlet 11 side in the working chamber 8.

Powder which has entered into the first and second spaces 21 and 22 in this embodiment, effectively falls down by the influence of gravity. Further, powder that falls down from the first space 21 can smoothly fall down without colliding with other powder that is being conveyed in the working chamber 8, since the powder inlet 11 is located higher than the powder outlet 12. The powder that falls down from the first space 21 and the powder that is being conveyed in the working chamber 8 flow downwards together. Accordingly, the powders do not collide each other because the powders are moving in the same direction and conveying ability of the powder in the working chamber 8 is increased.

Figure 6:
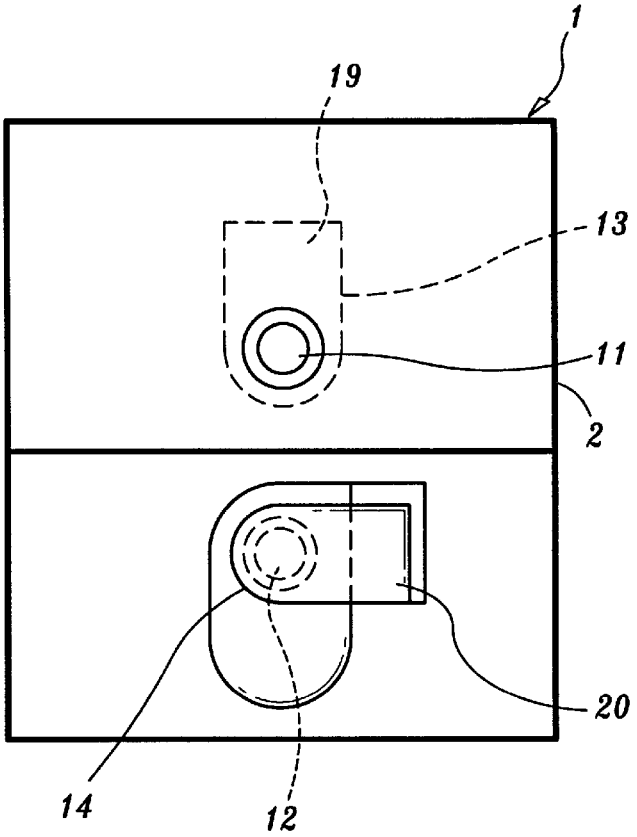
FIG. 6 is a view showing FIG. 5 as viewed from the left side with the second case member 3 in FIG. 5 removed.

FIG. 6 shows a view of FIG. 5 as viewed from the left side of FIG. 5 with the second case member 3 removed. In this example, the inlet valve 13 and the outlet valve 14 are formed as independent members separate from the diaphragm 5. Further, each of the base end portions 19 and 20 of valves 13 and 14, respectively, are fixed on an attaching surface of the case 4 with, for example, an adhesive in a manner similar to the example shown in FIGS. 1 through 4. The inlet valve 13 and the outlet valve 14 are composed of flexible members that open and shut the powder inlet 11 and the powder outlet 12, respectively, by swinging open at the base end portions 19 and 20 in a manner similar to the example shown in FIGS. 1 through 4. In the example in FIGS. 5 and 6, each of the valves 13 and 14 are composed of sheet-like flexible members. In this case, the inlet valve 13 and the outlet valve 14 are disposed in a position such that each of the shutting surfaces of the powder inlet 11 and the powder outlet 12 is standing in an up straight state as shown in FIGS. 5 and 6. Further, each base end portion 19 and 20 of the inlet valve 13 and outlet valve 14 is disposed at a position other than just under the powder inlet 11 and the powder outlet 12 to prevent accumulation of powder thereat.

In the construction as described above, powder that falls down from positions adjacent to the powder inlet 11 and the powder outlet 12, or the first and second space 21 and 22 smoothly falls down slipping along surfaces of each of the valves 13 and 14 and is thus prevented from adhering at these positions. Furthermore, the falling powder is prevented from accumulating at the positions adjacent to the base end portions 19 and 20 of each of the valves 13 and 14, since the base end portions 19 and 20 of each of the valves 13 and 14 are disposed at positions other than at the positions just under the powder inlet 11 and the powder outlet 12. Accordingly, the inlet valves 13 and 14 can always closely contact the ends 25 and 26, and perform predetermined open and shut operations. Thus, the pump can maintain the high conveying ability of the powder for long periods of time.

The other portions of the construction and action in the example shown in FIGS. 5 and 6 are not substantially different from those portions shown in FIGS. 1 through 4, and the construction of a driving device that operates the diaphragm is also the same. Although there are some differences between the constructions shown in FIGS. 1 through 4 and that shown in FIGS. 5 and 6 such as, for example, that the sheet-like base member 6 of the diaphragm 5 is not nipped between first and second case members 2 and 3, and is not fixed on the first case member 2 and the like, the differences are not significant for an understanding of the operation of the device. Therefore, the explanation of the features of the embodiment shown in FIGS. 5-6 that is substantially the same as those shown in FIGS. 1–4, is hereinafter omitted.

As can be understood from the example illustrated below, the powder pump 1 shown in FIGS. 1 through 6 can be utilized as a pump for conveying a toner that is used in an image forming apparatus. When used for conveying the toner as stated above, it is preferable to form the inlet and outlet valves 13 and 14 of a material having good tolerance to the toner.

For example, as an example shown in FIGS. 5 and 6, when the inlet valve 13 and the outlet valve 14 are formed of a flexible member that opens and shuts the powder inlet 11 and the powder outlet 12, respectively, by swinging around the base end portions 19 and 20 as centers, and constructed in separate bodies from the diaphragm 5, it is advantageous if the inlet valve 13 and the outlet valve 14 are composed of an ethylene-propylene rubber, a fluorine-containing rubber, a PET (polyethylene terephthalate) film, polyurethane sheet, or a Teflon-coated elastic sheet. Further, it is also advantageous if each of the valves 13 and 14 is composed of the above-mentioned material having a sheet-like shape in a thickness to the very limit of breaking, i.e., for example, about 0.05 mm to 1 mm, and which is easy to bend.

As a material of the diaphragm 5, for example, an ethylene-propylene rubber in rubber hardness of about 40° to 60° is advantageously used, and if the diaphragm 5 and the valves 13 and 14 are formed in a body, this can be composed of, for example, an ethylene-propylene rubber.

Since the powder pump 1 as explained above can be utilized as a conveying device for supplying powder, such as a toner or a two-component developer including a carrier, and for disposing of waste toner, a concrete example is explained hereinbelow.

Figure 7:
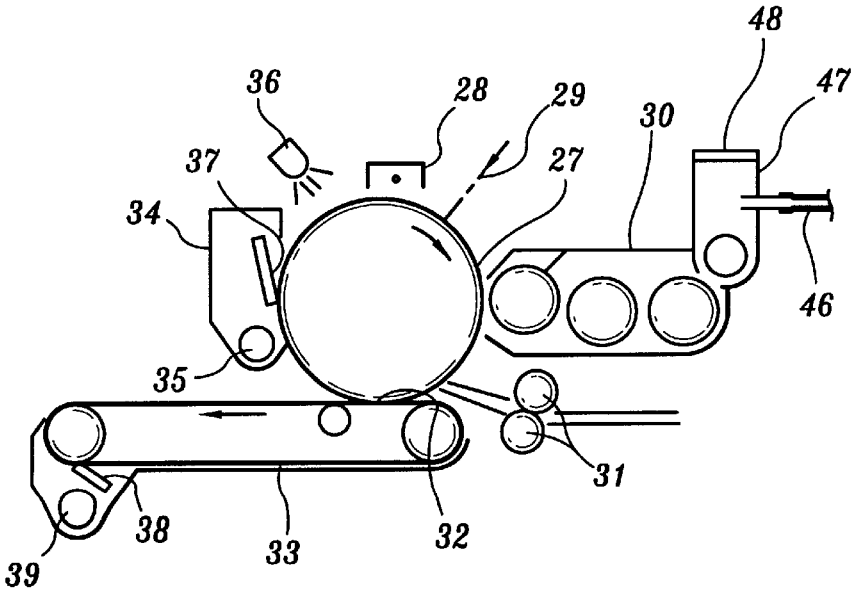
FIG. 7 is a schematic illustration showing an example of an image forming apparatus.

FIG. 7 is a schematic illustration of an image forming apparatus. A drum shaped photoconductive element 27 is rotated in a clockwise direction. The surface of the photoconductive element 27 is charged with a charging device 28, and an optical writing light 29 is irradiated onto the charged surface. An electrostatic latent image is formed on the surface of the photoconductive element 27. The electrostatic latent image is developed into a visible toner image with a developing device 30. A two-component type powder developer containing a toner and a carrier is used in the developing device 30.

On the other hand, a transfer sheet (not shown) fed from a sheet feeding device (not shown) is conveyed to a transfer section 32 being controlled in a predetermined timing with registration rollers 31. The toner image on the photoconductive element 27 is transferred onto the transfer sheet at transfer section 32. The transfer sheet is continuously conveyed being borne on a transfer belt 33 that is driven in a direction indicated by an arrow, and the toner image on the transfer sheet is fixed on the transfer sheet when passing through a fixing unit (not shown).

A used residual toner adhered on the surface of the photoconductive element 27 after the toner image transfer, is removed by a cleaning blade 37 of a cleaning device 34, and collected by the cleaning device 34. The collected used residual toner is conveyed towards a backside of the apparatus (which is perpendicular to the paper surface of the drawing), with a conveying coil 35, and the collected used residual toner is then discharged outside of the cleaning device 34. The surface of the photoconductive element 27 whose surface is cleaned is irradiated with light from a discharging lamp 36 and initialized.

Further, the used residual toner adhering on the surface of the transfer belt 33 is scraped off and removed with a cleaning blade 38. The used residual toner is also conveyed towards the backside of the apparatus, with a conveying coil 39.

Figure 8:
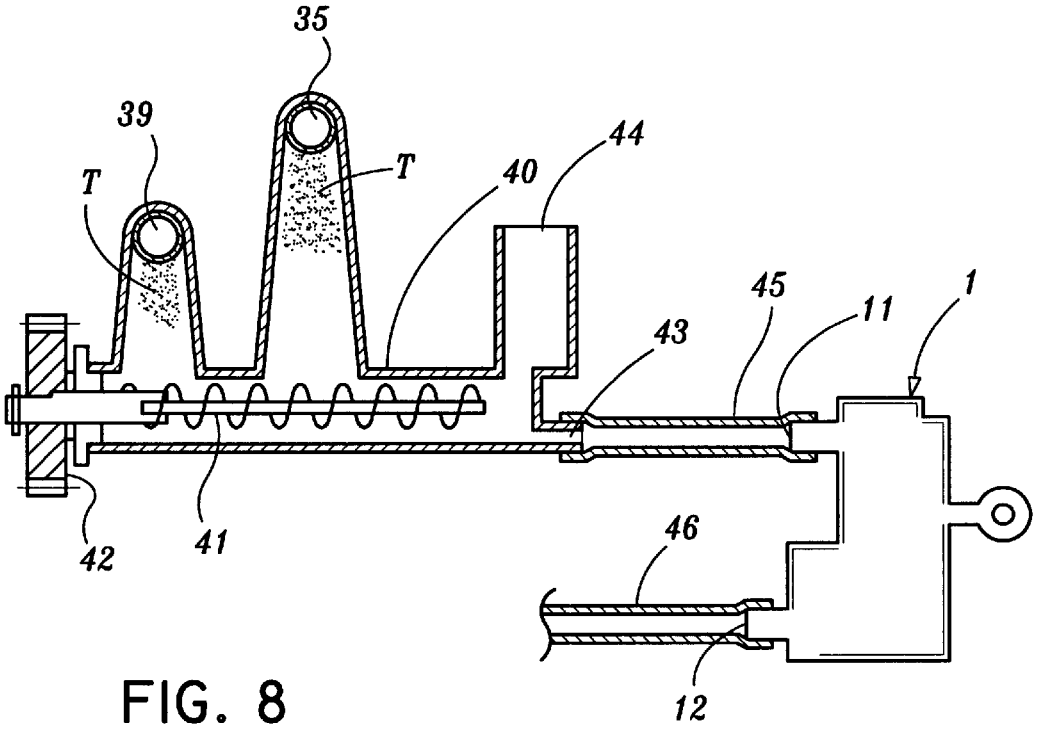
FIG. 8 is a cross sectional view showing an example of a powder pump that is used for conveying an accumulated toner to a toner hopper of the developing device.

As shown in FIG. 8, the used residual toner T that is conveyed with each of the conveying coils 35 and 39, as described above, enters a collecting case 40, and falls down towards a conveying screw 41 disposed there beneath. The conveying screw 41 is rotatably driven with a drive motor (not shown), via a gear 42, and thereby, the used residual toner is conveyed to an exit 43 of the case 40. The exit 43 is connected to the powder inlet 11 of the powder pump 1, which is composed of one of the embodiments explained above referring to FIGS. 1 through 6, via a hose 45.

An air inlet 44 is disposed above the exit 43, and air led from the air inlet 44 by an attracting force of the powder pump 1 is supplied to the used residual toner T and mixed with the toner T. The used residual toner as mentioned above is conveyed to the powder pump 1 through the hose 45, ejected from the powder outlet 12 of the powder pump 1, and conveyed to a toner hopper 47 of the developing device 30 (shown in FIG. 7), through a hose 46. An air filter 48 is mounted on the toner hopper 47, and excess air mixed in the used residual toner is disposed outside the toner hopper 47 through the air filter 48. If the air inlet 44, which is shown in FIG. 8, is communicated with the toner hopper 47 via a hose, there is no need to mount the air filter 48.

The used residual toner conveyed to the toner hopper 47 is supplied into the two-component developer in the developing device 30, and reused for developing the electrostatic latent image formed on the photoconductive element 27.

Figure 9:
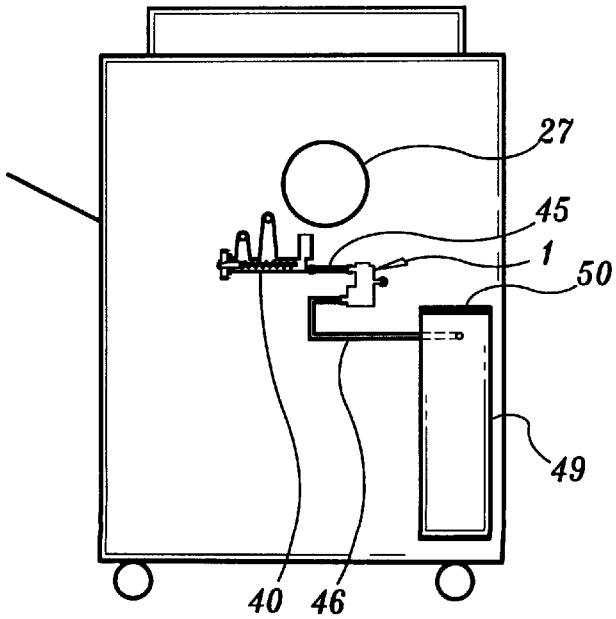
FIG. 9 is a schematic view showing an example of a powder pump that is used for conveying an accumulated toner to the waste toner tank.

The powder pump 1 is used in the example in FIGS. 7 and 8 for conveying the used residual toner to the toner hopper 47 of the developing device 30. However, the powder pump 1 can be used for conveying used residual toner collected in the collecting case 40 to a waste toner tank 49, as shown in FIG. 9. The waste toner tank 49 is also provided with an air filter 50. However, the air filter 50 can also be omitted if the waste toner tank 49 is communicated with the air inlet 44 (shown in FIG. 8).

Figure 10:
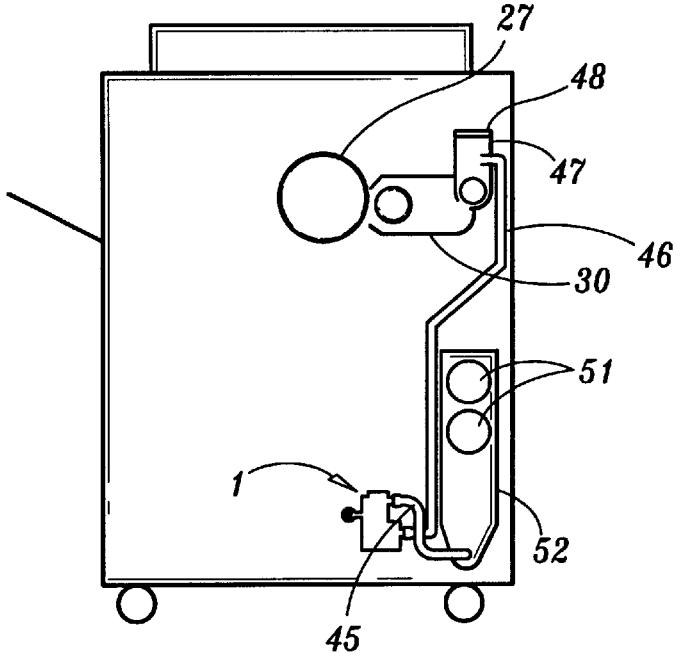
FIG. 10 is a schematic view showing an example of the powder pump that is used for conveying the toner from a toner bank to the toner hopper.

FIG. 10 illustrates an example of powder pump 1 used for conveying the toner fed from a toner bank 52 containing the toner supplied from a toner bottle 51, to the toner hopper 47 of the developing device 30. The toner from the toner bank 52 is conveyed to the powder pump 1 via the hose 45, and then conveyed to the toner hopper 47 with pressure from the powder pump 1 via the hose 46. The toner is then mixed into the developer in the developing device 30 for developing the electrostatic latent image on the photoconductive element 27.

The powder pump in the present invention can be used for conveying various powders other than that of the above mentioned example.

Figure 14:
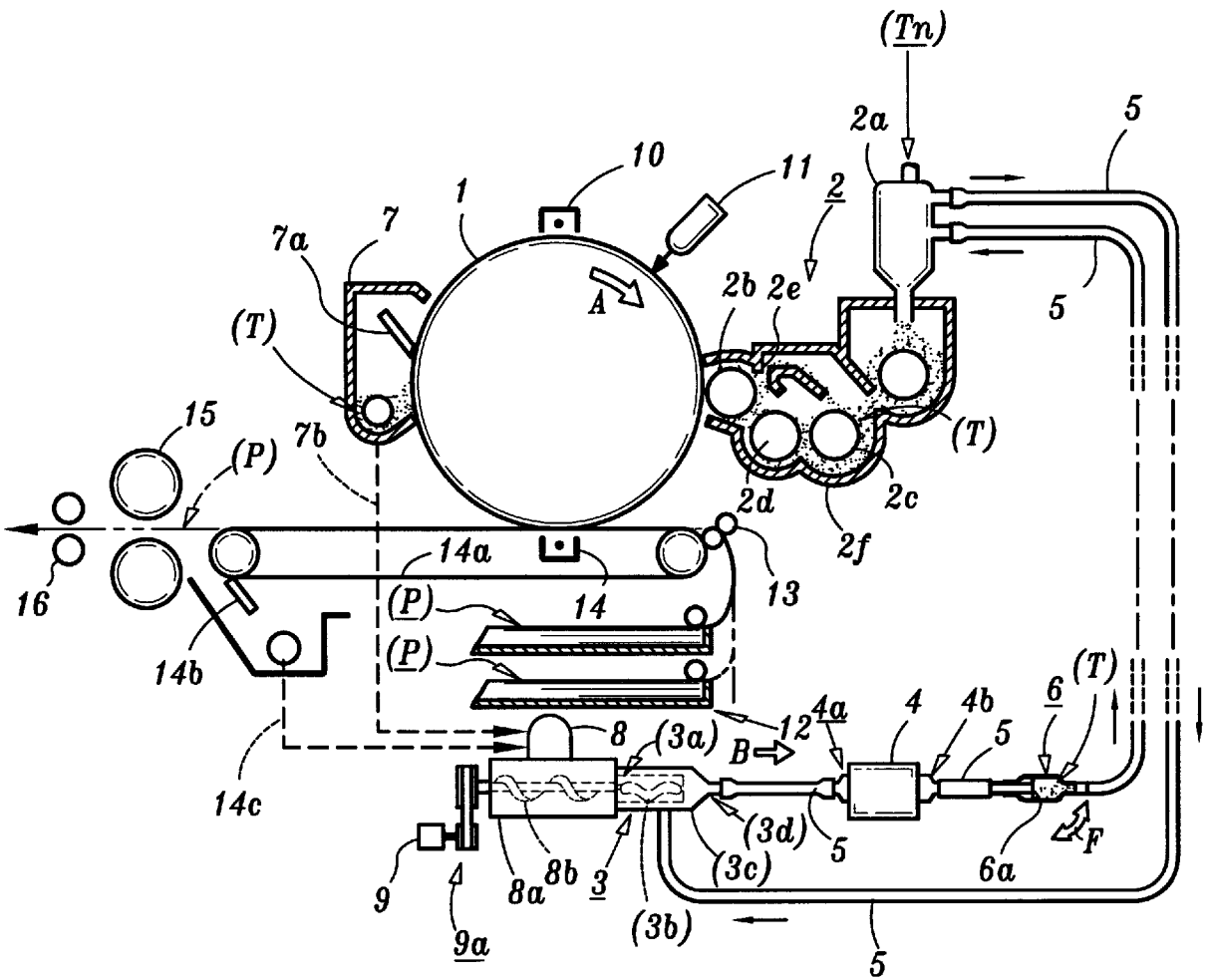
FIG. 14 is an illustration showing an example of the image forming apparatus of the present invention.
Figure 15:
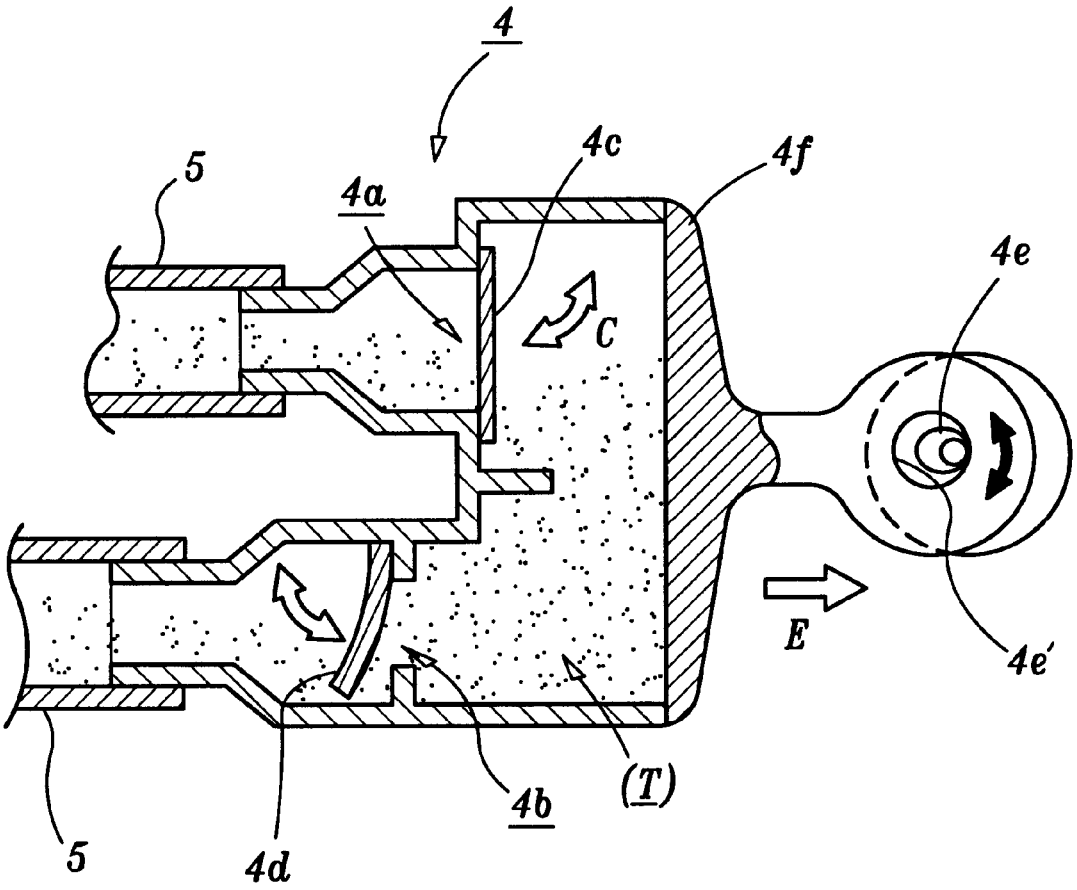
FIG. 15 is an enlarged illustration of an example of the image forming apparatus of the present invention.

Another embodiment of the present invention is explained hereinafter with reference to the drawings. In FIGS. 14 and 15, a drum-shaped image bearing member 1 is held for rotation relative to a side plate (not shown), and rotated in a clockwise direction as indicated by an arrow A by a driving device (not shown). A toner image is formed on the image bearing member 1 by an image forming process such as an electrophotography process. An electrostatic latent image is formed on the image bearing member 1 by exposing light corresponding to an image using an exposing device 11 after the image bearing member 1 is uniformly charged by a charger 10. The image bearing member 1 bears a toner image that is formed by a developing device 2.

Further, a drum-shaped photoconductive element of the aforementioned image bearing member 1 can be made in a shape of an endless belt. The exposing device 11 can be an analog-optical system of a copying machine, or constructed of a laser printer using a method of optical writing on the image bearing member 1 corresponding to an image signal, using a laser scanning optical system having a laser light source and a deflector. The exposing device can further be a digital copying machine or a facsimile machine by mounting an original document reading device on the apparatus.

The developing device 2 is composed of a developing roller 2*b* that supplies a toner T to the electrostatic latent image, which is formed and borne on the image bearing member 1. Paddles 2*c* and 2*d* agitate and convey the toner T. A blade 2*e* limits a height of the layer of the toner T, and a container 2*f* contains and supports these elements. A recycled toner that is to be reused and a new toner are supplied into the container 2*f* being conveyed through an elastic tube of a mixed gas conveying device 5 by a screw pump 3 and a powder pump 4.

Accordingly, a new toner Tn that is appropriately stored in a developer containing device (not shown) provided separate from the developing device 2 can also be supplied into the container 2*f* via hopper 2*a* by an above-described screw pump 3 (not shown) and a powder pump 4.

The electrostatic latent image formed and borne on the image bearing member 1 is developed by a magnetic-brush type developing 15 method using a dry type one-component or two-component developer (toner and carrier) with the toner T supplied from the developing device 2. The toner T in the container 2*f* of the developing device 2 is conveyed while being agitated by the paddles 2*c* and 2*d*, and the toner T is adhered to the carrier by an electrostatic force produced by friction of the carrier and the toner T.

Further, the toner T forms a magnetic-brush on the developing roller 2*b* with a built-in magnet (not shown), and a developing operation is executed with the toner T conveyed onto the image bearing member 1. A plurality of sheet cassettes containing transfer sheets P of various sizes are mounted in a sheet feeding section 12.

When an image forming operation is started, the image bearing member 1 is charged with the charger 10, and the electrostatic latent image is formed by exposing the original image from the exposing device 11. The electrostatic latent image is developed with the dry type one-component developer or with a dry type two-component developer, and the toner image is formed on the image bearing member 1. The toner image on the image bearing member 1 is transferred onto the transfer sheet P that is fed from the sheet feeding section 12 and conveyed to a transfer position, namely, a nip position of an image bearing member 1 and a transfer device 14 via a registration roller 13.

Then, the transfer sheet P on which the toner image is transferred is conveyed from the transfer device 14 to the fixing unit 15. The toner image is fixed to the transfer sheet P at the fixing unit 15, and the transfer sheet P after transfer is discharged via a discharging roller 16 and stacked on a sheet tray.

On the other hand, used residual toner that adheres on the image bearing member 1 after the toner image is transferred, or the toner T adhered on a transfer belt 14*a* is scraped off by a cleaning blade 7*a* of a cleaning unit 7 or a transfer belt cleaning blade 14*b*. The accumulated toner T discharged from a discharging tube 7*b* or a discharging tube 14*c* is conveyed to the screw pump 3 via a connecting device 8, and the toner T is mixed with air supplied from the screw pump 3 (via tube 5) and the powder pump 4 to become mixed gas. The mixed gas (toner and air) is conveyed in a toner conveying direction as indicated by an arrow B in the drawing, and eventually supplied into the container 2*f* of the developing device 2.

The screw pump 3 includes a rotor 3*b* which moves new toner Tn appropriately supplied from a toner containing device (not shown) and which is separately provided from the developing device 2, or residual toner T supplied with the discharging tube 7*b* or the like, through a path disposed around the rotor 3*b*, and a holder 3*c* which supports and fixes a stator 3*a* into which the rotor 3*b* fits.

In the powder pump 4 as shown in FIG. 15, an inlet valve 4*c* is held swingable in the direction indicated by an arrow C, over an inlet 4*a*, and an outlet valve 4*d* is held swingable in the direction indicated by an arrow D, over an outlet 4*b*. When inhaling the mixed gas of toner T and air by action of a diaphragm 4*f* in a direction indicated by an arrow E or in a direction opposite to the direction indicated by arrow E by rotation of an eccentric cam 4*e*, the inlet valve 4*c* opens the inlet 4*a*, and the outlet valve 4*d* shuts the outlet 4*b*, and vice versa. Thus, the mixed gas of toner T and the air for fluidifying the toner T is conveyed, and the air for fluidifying the toner T is circulated so that the air is reused.

The mixed gas of the toner T that is conveyed by the screw pump 3 and the air for fluidifying the toner T, which is circulated and supplied by the powder pump 4 are conveyed to the hopper 2*a* that supplies the toner into the container 2*f* of the developing device 2 being conveyed in a direction of toner conveying (i.e., in a direction indicated by an arrow B through an elastic tube of the mixed gas conveying device 5). The hopper 2*a* as mentioned above supplies the toner T mixed with air that is provided thereto after being conveyed through the elastic tube of the mixed gas conveying device (tube) 5, into the container 2*f*, by dropping the toner T and separating the toner T from the air by gravity.

A flowing-back preventing device 6 has a construction including a valve member 6*a* that prevents toner T from flowing back into powder pump 4 when the powder pump 4 stops or the like. The toner T can be prevented from flowing back by providing a valve 6*a* of the flowing-back preventing member 6 which is only capable of opening and shutting in a direction indicated by an arrow F, in line with an elastic tube of the mixed gas conveying device 5 and connected at a side of the outlet 4*b* of the powder pump 4.

The air that is separated from the toner T in the hopper 2*a* is reused after being supplied into the screw pump 3 through a circulating path from hopper 2*a* via the mixed gas conveying device tubes 5.

Accordingly, a gap which occurs between the stator 3*a* and the rotor 3*b* in the screw pump 3 caused by wear occurring over time does not effect operation of the device, since the air is reused in the screw pump 3. That is, the air is supplied and recirculated in order of the powder pump 4, the hopper 2*a* of the developing device 2, conveying device (tubes) 5, the screw pump 3, and the powder pump 4. Accordingly, even though the gap may occur, air leakage to the open air can be prevented, and the toner can be conveyed to the hopper 2*a* of the developing device 2 without decreasing conveying ability for the toner T from the outlet 3*d* of the screw pump 3. Thus, an image forming apparatus capable of producing a high quality image can be provided.

Figure 16:
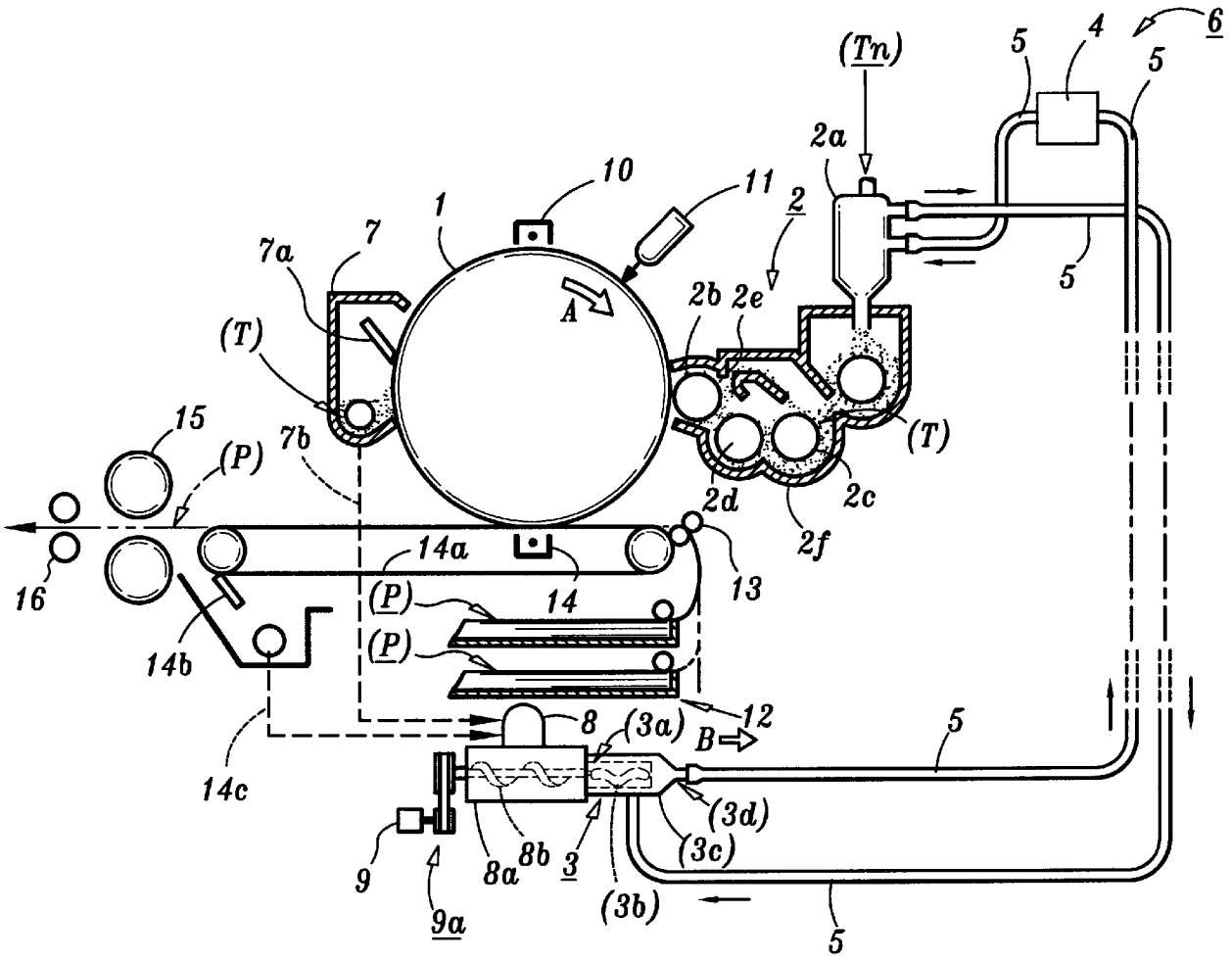
FIG. 16 is an illustration showing another example of the image forming apparatus of the present invention.

In FIG. 16, powder pump 4 is provided at a position higher than the hopper 2*a* of the developing device 2 in a vertical direction and thus acts as a flowing back preventing device 6. Accordingly, flowing-back of the toner T towards the powder pump 4 can be prevented, even in a case when the powder pump 4 stops operation, without adding any additional parts, devices, or the like.

Figure 17:
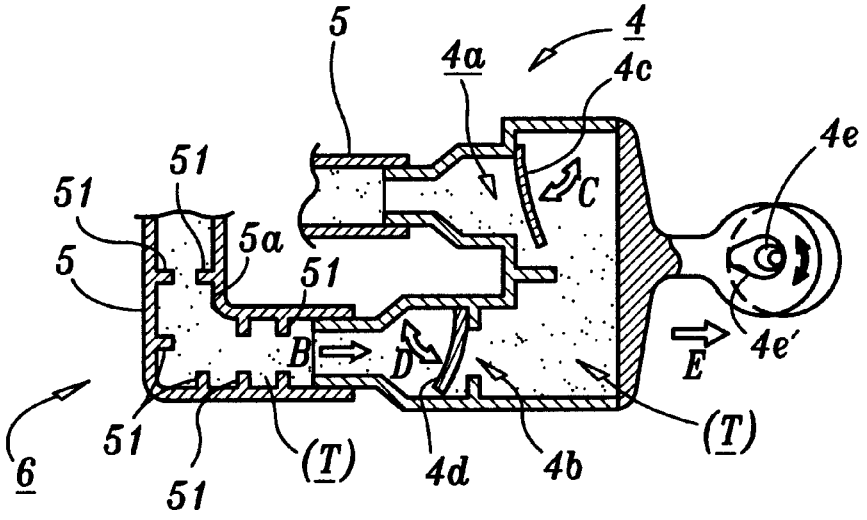
FIG. 17 is an illustration showing an example of a main part of an image forming apparatus.

According to another embodiment of the present invention as shown in FIG. 17, an internal wall 5*a* of the elastic tube of the mixed gas conveying device 5, including flowing-back preventing members 51 is connected to a side of the outlet 4*b* of the powder pump 4, so that the toner T is prevented from flowing back in a direction indicated by an arrow B.

Accordingly, even when supplying air that is reused in the screw pump 3, to the hopper 2*a*, and circulating in order of the powder pump 4, the hopper 2*a*, the circulating path including conveying device 5, the screw pump 3, and the powder pump 4 that is located at a position lower than the hopper 2*a*, toner T remaining at the internal wall 5*a* of the elastic tube or the like of the mixed gas conveying device 5 is prevented from flowing back towards the powder pump 4 side due to vibration and gravity, by the flowing-back preventing members 51, even if vibration occurs after stopping operation of the powder pump 4. In other words, this embodiment can prevent the outlet valve 4*d* from being blocked with the toner T caused by flowing-back of the toner t, or prevent the outlet valve 4*d* from not shutting properly because the outlet valve 4*d* has filled with the toner T. Thus, the function of the powder pump can operate normally and therefore, the image forming apparatus that can produce a high quality image is provided.

Figure 18:
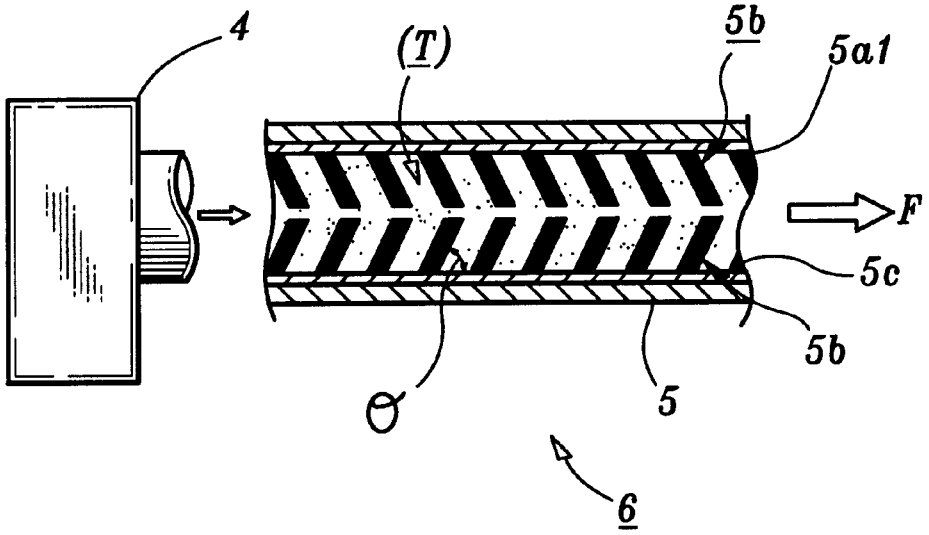
FIG. 18 is an example of an enlarged cross sectional view illustrating another main part of the present invention.

In FIG. 18, brushes 5*b* of the flowing-back preventing member 6 are made of a woven cloth provided along an internal wall 5*c* of the elastic tube forming conveying device 5. The elastic tube can consist of a vinyl tube composed of a material, such as polyester or acrylic resin. The brush 5*a* is inclined at an angle of 10° to 60° with the conveying direction of the toner T with air as the mixed gas as indicated by an arrow F. Therefore, a conveying resistance for the toner T in the mixed gas can be made even lower and the flowing-back problem can be prevented resulting in capability of conveying large amounts of the toner T.

Figure 19:
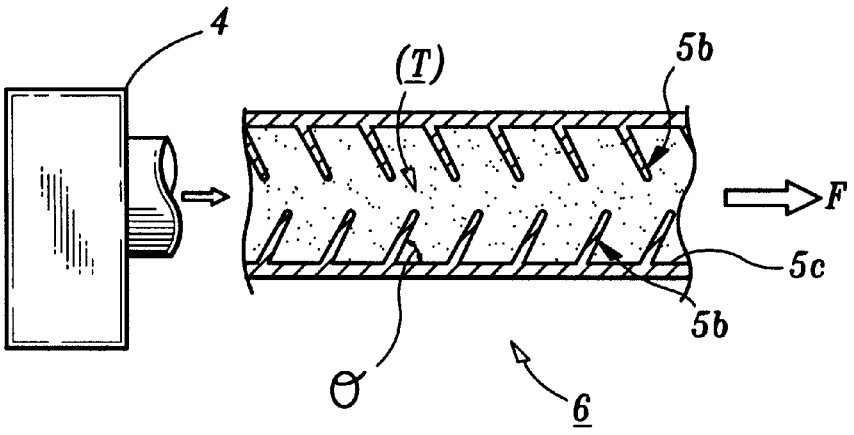
FIG. 19 is another example of an enlarged cross sectional view illustrating a main part of the image forming apparatus of the present invention.

In FIG. 19, a projection 5*b* of the flowing-back preventing member 6 is made by adhering two pieces of convex-shaped parts formed on the inner wall 5*c* into a tube when the rubber material of the mixed gas conveying device 5 is molded. The projection 5*b* is inclined at an angle of 10° to 60° with the conveying direction of the toner T with air as the mixed gas as indicated by an arrow F. Accordingly, since the resistance of the mixed gas is small, and a flowing-back of the toner T can securely be prevented, it became possible to convey a large amount of the toner.

Figure 20:
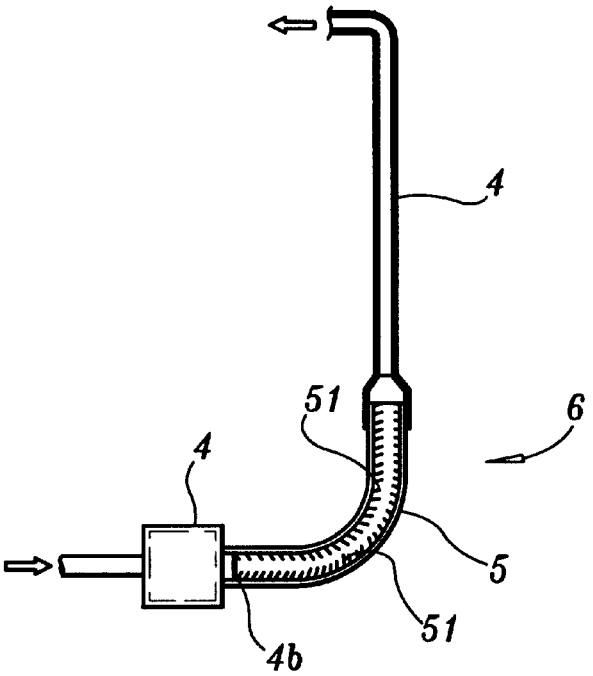
FIG. 20 is another example of an enlarged cross sectional view illustrating a main part of the image forming apparatus of the present invention.

As shown in FIG. 20, the flowing-back preventing member 6 can be provided in only a portion of the mixed gas conveying device 5 that is connected at the side of the outlet 4*b* of the powder pump 4. Accordingly, the entire mixed gas conveying device 5 need not be provided with the flowing-back preventing member 6. Accordingly, manufacturing costs can be decreased and the flowing-back of the toner T in the mixed gas can be prevented and therefore, conveying of a large amount of the toner T can be achieved.

Figure 21:
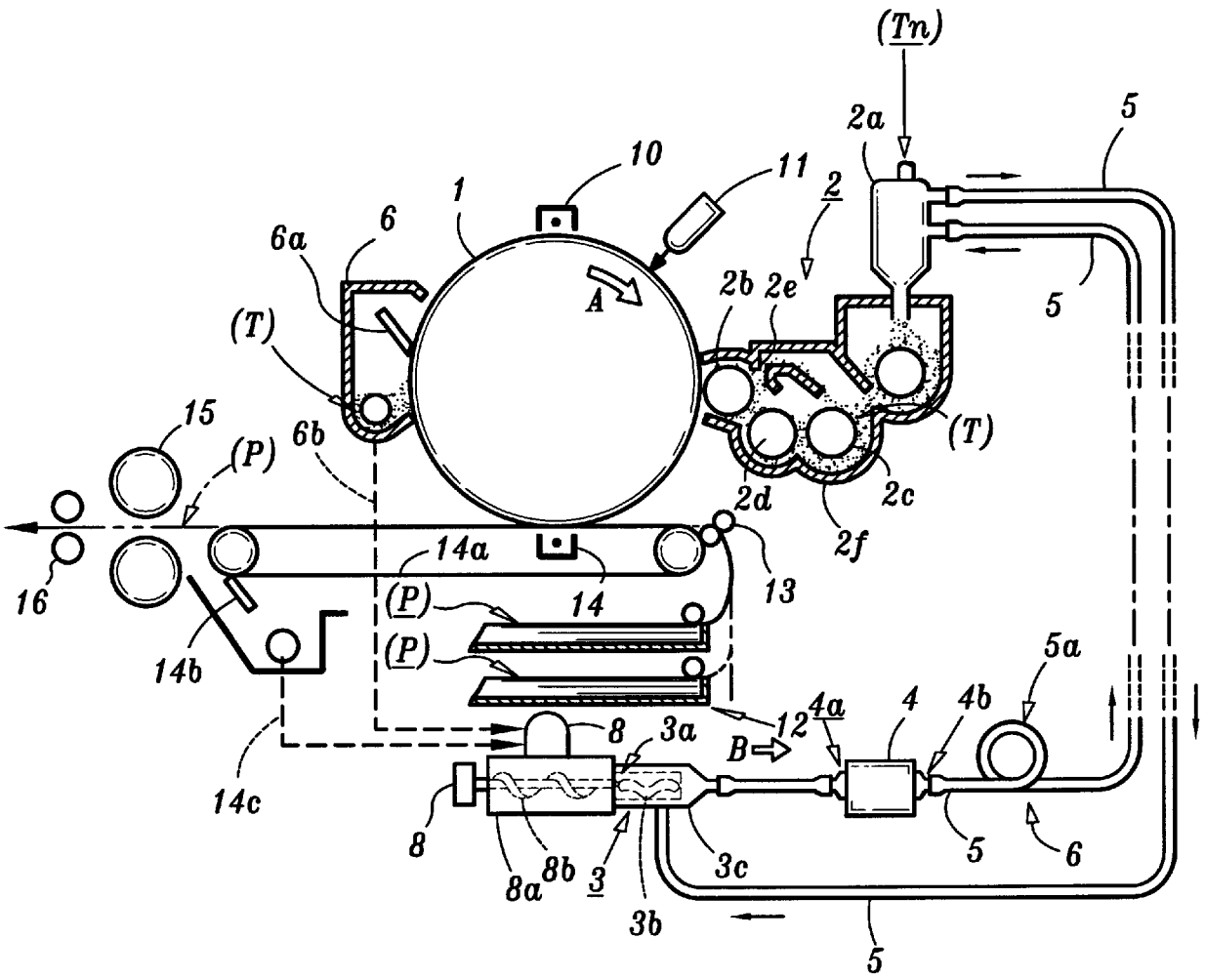
FIG. 21 is an illustration showing an image forming apparatus of another embodiment of the present invention.
Figure 22:
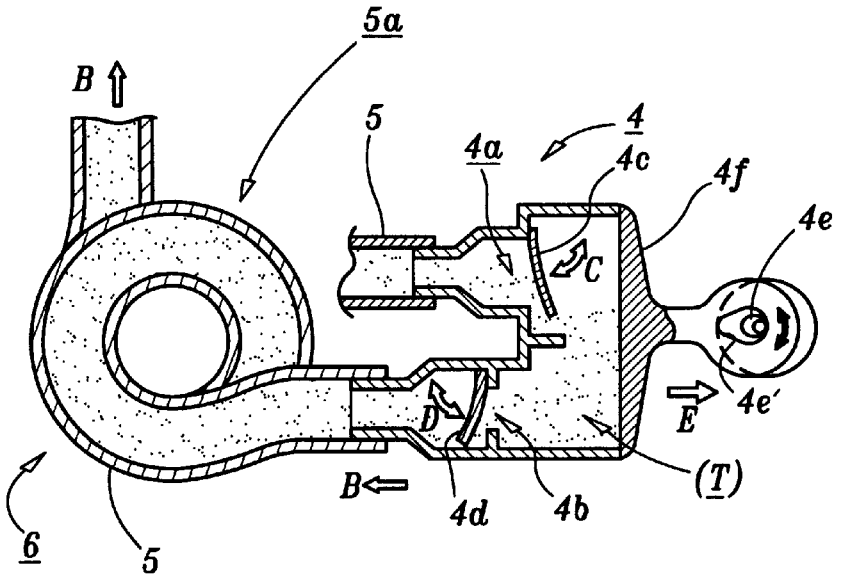
FIG. 22 is an enlarged illustration showing a main part of an image forming apparatus of the embodiment of the present invention.
Figure 23:
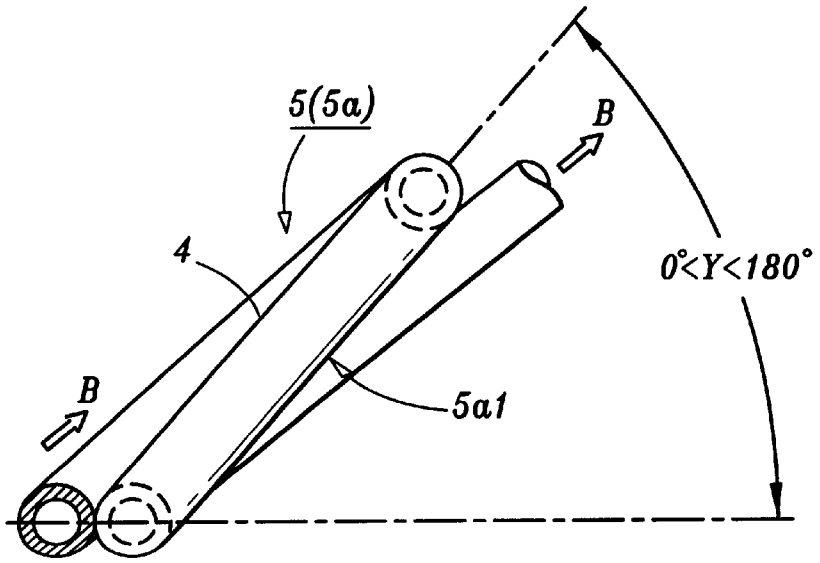
FIG. 23 is an illustration showing another state of the main part of the image forming apparatus of the embodiment of the present invention.

According to another embodiment of the present invention as shown in FIGS. 21 through 23, an internal wall of the elastic tube of the mixed gas conveying device 5 includes a loop-shaped part 5*a* forming the flowing-back preventing member 6. Loop-shaped part 5*a* is inclined at an angle Y of between 0 degree to 180 degrees or less to a horizontal surface that is perpendicular to the drawing on the paper surface as shown in FIG. 23. The loop-shaped part 5*a* is connected to the outlet 4*b* of the powder pump 4 so that the toner T is prevented from flowing back in a direction opposite to the direction indicated by arrow B.

Accordingly, even in a case of supplying air that is reused in the screw pump 8 to the toner supplying part 2*a* in the order of the powder pump 4, the toner supplying part 2*a*, the circulating path, the screw pump 3, and the powder pump 4 that is located at a position lower than the toner supplying part 2*a*, the toner T remaining at the loop-shaped part 5*a* of the internal wall of the elastic tube or the like of the mixed gas conveying device 5 is prevented from flowing back towards the powder pump 4 side due to vibration and gravity, if vibration occurs after stopping operation of the powder pump 4, without adding any additional devices or the like. In other words, the outlet valve 4*b* can be prevented from being blocked with the toner T due to the flowing-back of the toner T, and the problem of the valve seat of the outlet valve 4*d* not shutting because the outlet valve 4*d* is filled with the toner T can also be prevented. Thus, the function of the powder pump is kept normal and therefore, the image forming apparatus that can produce a high quality image is provided.

Figure 24:
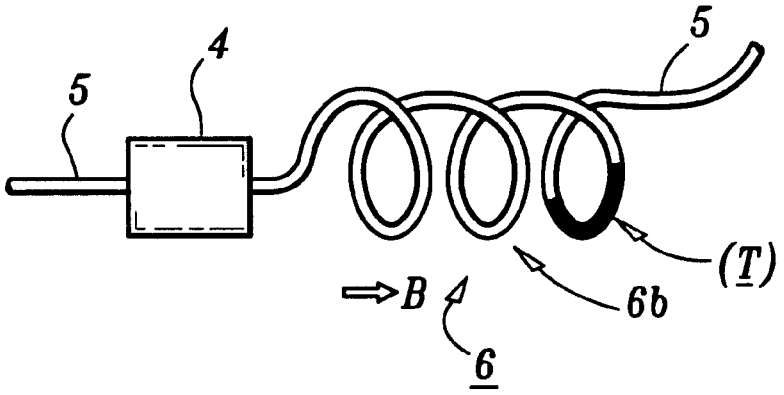
FIG. 24 is an illustration showing another example of the main part of the image forming apparatus of the embodiment of the present invention.

In FIG. 24, a spiral-shaped part 6*b* of the flowing-back preventing device 6 is a part of the elastic tube of the mixed gas conveying device 5 formed in a spiral shape towards a toner conveying direction indicated by an arrow B, and accordingly, flowing back of the toner T to the powder pump 4 is further securely prevented by the spiral-shaped part 6*b* without adding any additional devices or the like.

Figure 25:
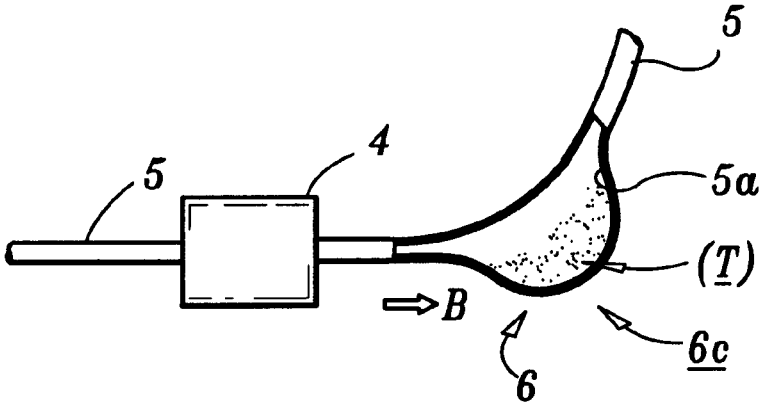
FIG. 25 is an illustration showing another example of the main part of the image forming apparatus of the fourth embodiment of the present invention.

In FIG. 25, a bag-shaped part 6*c* of the flowing-back preventing device 6 forms a bag-shaped toner pooling portion provided in an inner wall 5*a* of an elastic tube of the mixed gas conveying device 5 so that flowing back toner T is pooled in the toner pooling portion. The toner can thus be prevented from flowing back to the powder pump 4 without increasing a load resistance necessary for conveying the toner T in the toner conveying direction indicated by an arrow B.

Figure 26:
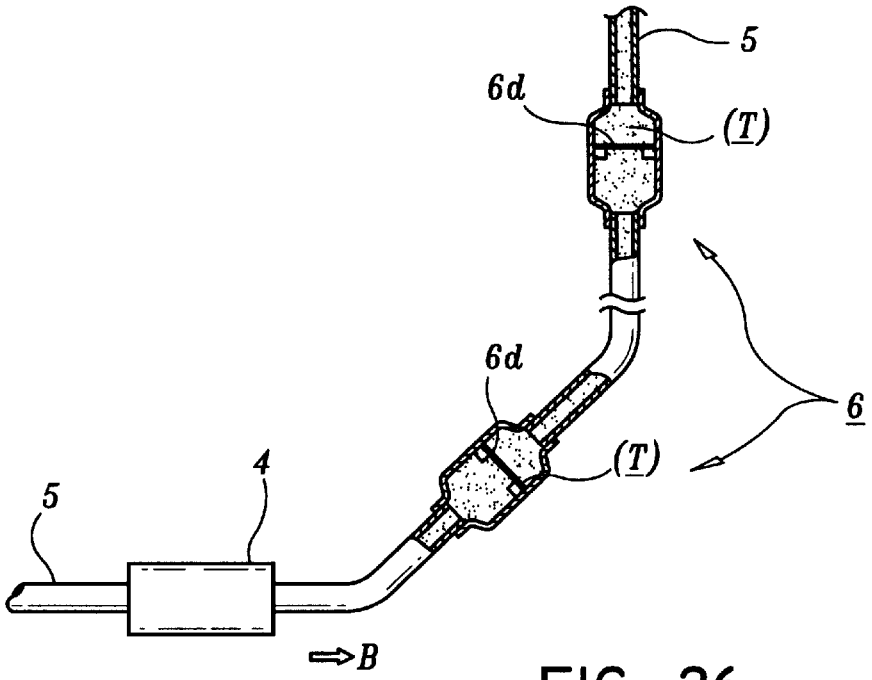
FIG. 26 is an illustration showing another example of the main part of the image forming apparatus of the embodiment of the present invention.

In FIG. 26, a flowing-back preventing valve 6*d* of the flowing-back preventing device 6 is a valve in which one or a plurality of opening and shutting members is provided in an internal wall of the elastic tube of the mixed gas conveying device 5 that allows the toner T to pass in a toner discharging direction i.e., the toner conveying direction indicated by an arrow B, and prevents the toner T from passing in a direction opposite to the toner conveying direction. As a result, the flowing-back of the toner T towards the powder pump can be prevented without increasing the length of the elastic tube of the mixed gas conveying device 4.

Figure 27:
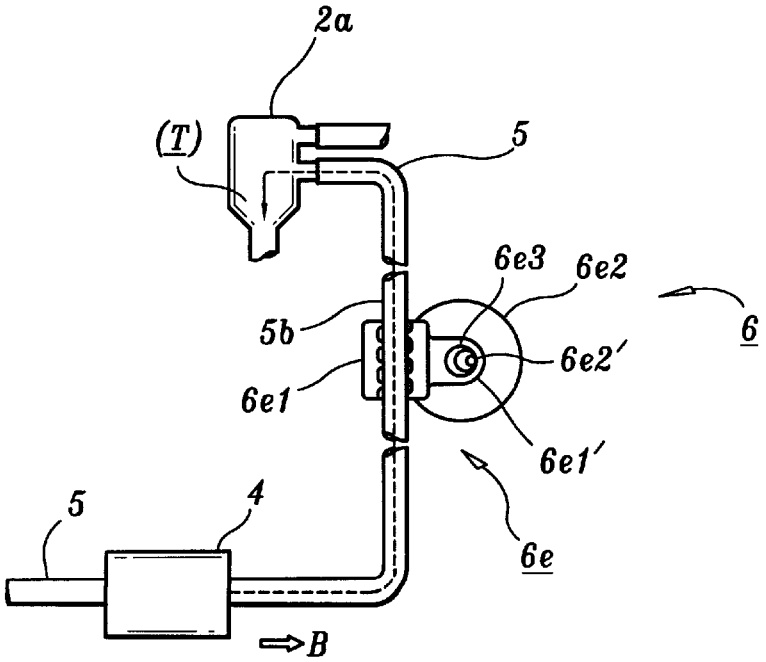
FIG. 27 is an illustration showing another example of the main part of the image forming apparatus of the embodiment of the present invention.

In FIG. 27, a vibration adding device 6*e* of the flowing-back preventing device 6 is a device which includes a vibration adding member 6*e*1. An outer wall 5*b* of the elastic tube of the mixed gas conveying device 5 is nipped with the vibration adding member 6*e*1 that adds vibration to the elastic tube of the mixed gas conveying device 5 by rotation of an eccentric cam 6*e*3 that is driven by a rotation driving of a motor 6*e*2 during the conveyance of the toner T to the toner conveying direction indicated by an arrow B. The vibration adding member 6*e*1 of the flowing-back preventing device 6 is used to clean the inside of the elastic tube of mixed gas conveying device 5 during the working time periods of the powder pump 4, thus preventing toner from remaining on the inside wall of conveying device (tubes) 5. Thus, the flowing-back of the toner T to the powder pump 4 is prevented by preventing toner buildup in the elastic tube of the mixed gas conveying device 5.

Obviously, numerous modifications and variations of the present invention are possible in light of the above teachings. It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth herein.

This application is based on Japanese Patent Applications No. 09-116424, filed on Apr. 18, 1997, No.XX-XXXXXX, filed on XXXX XX, XXXX, No.XX-XXXXXX, filed on XXXX XX, XXXX, and No. XX-XXXXXX, filed on XXXX XX, XXXX respectively the entire contents of which are herein incorporated by reference.

What is claimed is:

1. A powder pump comprising:

a case;

a diaphragm;

a working chamber which is partitioned with said case and said diaphragm;

a powder inlet formed in said case for flowing the powder into said working chamber;

a powder outlet formed in said case for flowing the powder in said working chamber out of said powder outlet;

an inlet valve for opening said powder inlet when pressure in said working chamber is lowered by an operation of said diaphragm, so as to let the powder flow into said working chamber through said powder inlet, and for shutting said powder inlet when the pressure in said working chamber is raised by the operation of said diaphragm; and an outlet valve for opening said powder outlet when the pressure in said working chamber is raised by the operation of said diaphragm, so as to let the powder flow outside of said working chamber through said powder outlet, and for shutting said powder outlet when the pressure in said working chamber is lowered by the operation of said diaphragm;

a first space formed so as to communicate with said working chamber and located at a place around a case wall part which partitions said powder inlet; and a second space formed so as to communicate with a powder flowing path located at the downstream side of a powder conveying direction from said outlet valve and at a place around a case wall part which partitions said powder outlet.

2. The powder pump according to claim 1, wherein said case wall part partitioning said powder inlet is formed in a cylindrical shape, and wherein said first space is disposed around an entire periphery of said case wall part.

3. The powder pump according to claim 1, wherein said case wall part which partitions said powder outlet is formed in a cylindrical shape, and wherein said second space is disposed around an entire periphery of said case wall part.

4. The powder pump according to claim 1, wherein said powder inlet is located in a position higher than said powder outlet so that the powder flowing into said working chamber from said powder inlet can fall down from a powder inlet side towards a powder outlet side in said working chamber.

5. The powder pump according to claim 1, wherein said inlet valve and said outlet valve are respectively composed of a flexible member for opening and shutting said powder inlet and said powder outlet respectively by swinging around respective base parts, and wherein contacting surfaces of said inlet valve and said outlet valve for shutting said powder inlet and said powder outlet are disposed in a posture of standing up straight, wherein each of said base parts of said inlet valve and said outlet valve are disposed at places other than just under said powder inlet and said powder outlet.

6. The powder pump according to claim 1, wherein said inlet valve and said outlet valve are composed of a flexible member for opening and shutting said powder inlet and said powder outlet respectively by swinging around base parts, and wherein said inlet valve and said outlet valve are composed of an ethylene-propylene rubber, a fluorine-containing rubber, a polyethylene a terephthalate film, and a polyurethane sheet or a Teflon-coated elastic sheet.

7. An image forming apparatus for forming an image with a toner, conveyed with a screw pump to an electrostatic latent image formed on an image bearing member using an electrophotography process, together with mixed gas supplied from a position apart from a developing position, comprising:

an image bearing member for bearing a formed image;

a developing device for forming a toner image by developing the electrostatic latent image formed on said image bearing member;

a screw pump for conveying the toner supplying to the image bearing member;

a powder pump provided inline between the developing device and the screw pump for circulatingly supplying gas for fluidifying the toner conveyed by said screw pump;

a mixed gas conveying device, connected between an outlet of said screw pump and an inlet of said powder pump, for conveying the mixture of toner and gas, and which conveys the gas in a circulating path which circulates the gas in order of said developing device, said screw pump, said powder pump, and said developing device.

8. The image forming apparatus according to claim 7, wherein said developing device includes a hopper for supplying the toner which is conveyed by said screw pump separately from the gas.

9. The image forming apparatus according to claim 7, wherein a flowing-back preventing device is provided for preventing a toner from flowing back to said powder pump.

10. The image forming apparatus according to claim 9, wherein said conveying device is also connected between said outlet of said powder pump and the developing device and wherein said flowing-back preventing device comprises a flowing-back preventing member provided in said mixed gas conveying device which is connected to said outlet of said powder pump.

11. The image forming apparatus according to claim 9, wherein said flowing-back preventing device is comprised of said powder pump located at a position higher than a hopper of said developing device in a vertical direction.

12. An image forming apparatus for forming an image with a toner, conveyed with a screw pump to an electrostatic latent image formed on an image bearing member using an electrophotography process, together with mixed gas supplied from a position apart from a developing position, comprising:

an image bearing member for bearing a formed electrostatic latent image;

a developing device for forming a toner image by developing the electrostatic latent image formed on said image bearing member;

a powder pump for circulatingly supplying gas for mixing with the toner for fluidifying the toner to be supplied to said developing device;

a mixed gas conveying device for conveying the toner and gas mixture, a section of the mixed gas conveying device being connected to an inlet of said powder pump and a section being connected to an outlet of said powder pump, and forming a circulating path for circulating the gas;

a flowing-back preventing member for preventing toner from flowing-back to said powder pump, said flowing-back preventing member being formed on an internal wall of the section of said mixed gas conveying device connected to the outlet of said powder pump.

13. The image forming apparatus according to claim 12, wherein said flowing-back preventing member comprises a brush.

14. The image forming apparatus according to claim 12, wherein said flowing-back preventing member comprises a projection.

15. The image forming apparatus according to claim 12, wherein said flowing-back preventing member is inclined in a direction of a toner conveying direction.

16. The image forming apparatus according to claim 12, wherein said flowing-back preventing member is disposed at only a part of said mixed gas conveying device connected to a side of said outlet of said powder pump.

17. An image forming apparatus for forming an image with a toner, conveyed with a screw pump to an electrostatic latent image formed on an image bearing member using an electrophotography process, together with gas as mixed gas supplied from a position apart from a developing position, comprising:

an image bearing member for bearing a formed electrostatic latent image;

a developing device for forming a toner image by developing the electrostatic latent image formed on said image bearing member;

a powder pump for circulatingly supplying a gas for mixing with the toner for fluidifying toner to be supplied to said developing device;

a mixed gas conveying device for conveying the mixture of toner and gas, a section of the mixed gas conveying device being connected to an inlet of said powder pump and a section of the mixed gas conveying device being connected to an outlet of said powder pump, and forming a circulating path for circulating the gas;

a flowing-back preventing member connected to the outlet of said powder pump for preventing toner, which collects in the section of said mixed gas conveying device connected to the outlet of said powder pump, from flowing back into the outlet of said powder pump.

18. The image forming apparatus according to claim 17, wherein said flowing-back preventing member stops a flow back of the toner at a loop-shaped part of said mixed gas conveying device.

19. The image forming apparatus according to claim 18, wherein a loop surface of said loop shaped part has a inclination of 0° or greater and 180° or less with a horizontal surface.

20. The image forming apparatus according to claim 17, wherein said flowing-back preventing member stops the flowing back of the toner at a spirally shaped part of said mixed gas conveying device.

21. The image forming apparatus according to claim 17, wherein said flowing-back preventing member stops the flowing-back of the toner at a bag-shaped part mounted on an internal wall of said mixed gas conveying device.

22. The image forming apparatus according to claim 17, wherein said flowing-back preventing member stops the flowing-back of the toner with a flowing-back preventing valve formed in said mixed gas conveying device.

23. The image forming apparatus according to claim 17, wherein said flowing-back preventing member stops the flowing-back of the toner with a plurality of flowing-back preventing valves formed in said mixed gas conveying device.

24. The image forming apparatus according to claim 17, wherein said flowing-back preventing member stops the flowing-back of the toner with a vibration adding device which vibrates said mixed gas conveying device.

* * * * *